US011724789B2

(12) United States Patent
Jung et al.

(10) Patent No.: US 11,724,789 B2
(45) Date of Patent: Aug. 15, 2023

(54) BOIL-OFF GAS RE-LIQUEFYING METHOD FOR LNG SHIP

(71) Applicant: DAEWOO SHIPBUILDING & MARINE ENGINEERING CO., LTD., Geoje-si (KR)

(72) Inventors: Hae Won Jung, Seoul (KR); Dong Eok Kang, Busan (KR); Joon Chae Lee, Seoul (KR); Dong Kyu Choi, Busan (KR)

(73) Assignee: DAEWOO SHIPBUILDING & MARINE ENGINEERING CO., LTD., Geoje-si (KR)

( * ) Notice: Subject to any disclaimer, the term of this patent is extended or adjusted under 35 U.S.C. 154(b) by 75 days.

(21) Appl. No.: 16/480,634

(22) PCT Filed: Jan. 24, 2018

(86) PCT No.: PCT/KR2018/001078

§ 371 (c)(1),
(2) Date: Jul. 24, 2019

(87) PCT Pub. No.: WO2018/139856

PCT Pub. Date: Aug. 2, 2018

(65) Prior Publication Data

US 2019/0351988 A1 Nov. 21, 2019

(30) Foreign Application Priority Data

Jan. 25, 2017 (KR) ..... 10-2017-0012151
Jan. 26, 2017 (KR) ..... 10-2017-0012753

(51) Int. Cl.
*F28F 9/02* (2006.01)
*F25J 1/00* (2006.01)
(Continued)

(52) U.S. Cl.
CPC ..... *B63J 2/12* (2013.01); *B63B 25/16* (2013.01); *B63H 21/38* (2013.01); *F02B 43/00* (2013.01);
(Continued)

(58) Field of Classification Search
CPC ..... F25J 1/0022; F25J 1/0025; F25J 1/0228; F25J 1/0242; F25J 1/0277; F25J 5/002;
(Continued)

(56) References Cited

U.S. PATENT DOCUMENTS 5,368,096 A 11/1994 Williams
5,967,224 A * 10/1999 Iwanaga ..... B60H 1/00021 165/42
(Continued)

FOREIGN PATENT DOCUMENTS

EP 2808633 A2 12/2014
GB 1472533 A 5/1997
(Continued)

OTHER PUBLICATIONS

International Search Report of corresponding PCT Patent Application No. PCT/KR2018/001078—4 pages (dated Apr. 26, 2018).
(Continued)

*Primary Examiner* — Frantz F Jules
*Assistant Examiner* — Jason N Thompson
(74) *Attorney, Agent, or Firm* — K&L Gates LLP

(57) ABSTRACT

Disclosed herein is a BOG reliquefaction method for LNG ships. The BOG reliquefaction method for LNG ships includes: 1) compressing BOG; 2) cooling the BOG compressed in Step 1) through heat exchange between the compressed BOG and a refrigerant using a heat exchanger; 3) expanding the BOG cooled in Step 2); and 4) stably maintaining reliquefaction performance regardless of change in flow rate of the BOG compressed in Step 1) and
(Continued)

supplied to the heat exchanger to be used as a reliquefaction target.

1 Claim, 28 Drawing Sheets

(51) Int. Cl.

| | |
|---|---|
| ***F25J 1/02*** | (2006.01) |
| ***F25J 5/00*** | (2006.01) |
| ***B63J 2/12*** | (2006.01) |
| ***B63B 25/16*** | (2006.01) |
| ***B63H 21/38*** | (2006.01) |
| ***F02B 43/00*** | (2006.01) |
| ***F02M 21/02*** | (2006.01) |
| ***F02M 21/06*** | (2006.01) |
| ***F28D 9/00*** | (2006.01) |
| *B63J 99/00* | (2009.01) |
| *F02B 43/10* | (2006.01) |
| *F28D 21/00* | (2006.01) |

(52) U.S. Cl.
CPC .... *F02M 21/0215* (2013.01); *F02M 21/0287* (2013.01); *F02M 21/06* (2013.01); *F25J 1/0025* (2013.01); *F25J 1/0254* (2013.01); *F25J 1/0277* (2013.01); *F25J 5/002* (2013.01); *F28D 9/0006* (2013.01); *F28F 9/0278* (2013.01); *B63J 2002/125* (2013.01); *B63J 2099/003* (2013.01); *F02B 2043/103* (2013.01); *F25J 1/0202* (2013.01); *F25J 2290/62* (2013.01); *F28D 2021/0033* (2013.01)

(58) Field of Classification Search
CPC ..... F25J 2210/90; F28F 9/026; F28F 9/0268; F28F 9/0278; F28F 9/028; F28F 2265/26; F28F 2265/14; F28F 9/0265
See application file for complete search history.

(56) References Cited

U.S. PATENT DOCUMENTS

| | | | | |
|---|---|---|---|---|
| 2003/0111216 | A1 | 6/2003 | Hirao et al. | |
| 2007/0028627 | A1* | 2/2007 | Moracchioli | F17C 11/005 62/50.2 |
| 2007/0256817 | A1* | 11/2007 | Toda | F28F 9/026 165/143 |
| 2009/0020275 | A1* | 1/2009 | Neher | F28F 9/0236 165/170 |
| 2009/0282840 | A1* | 11/2009 | Chen | F25J 1/0251 62/50.3 |
| 2011/0056238 | A1* | 3/2011 | Mak | F25J 1/0222 62/614 |
| 2011/0056652 | A1* | 3/2011 | Neher | F28F 9/0241 164/47 |
| 2011/0226455 | A1* | 9/2011 | Al-Anizi | F28F 9/0265 165/177 |
| 2013/0081794 | A1* | 4/2013 | Tuchowski | F02M 31/08 165/165 |
| 2013/0112381 | A1* | 5/2013 | Valente | F28F 9/0278 165/159 |
| 2014/0060789 | A1* | 3/2014 | Rousseau | F28D 21/0003 165/166 |
| 2014/0290279 | A1* | 10/2014 | Lee | F25J 1/0277 62/48.2 |
| 2014/0338874 | A1 | 11/2014 | Jindou et al. | |
| 2015/0136366 | A1* | 5/2015 | Fukui | F28D 7/005 165/148 |
| 2015/0226379 | A1 | 8/2015 | Lee et al. | |
| 2015/0330574 | A1* | 11/2015 | Fuchs | F25J 1/005 62/48.2 |
| 2016/0040942 | A1* | 2/2016 | Dziubinschi | F28F 9/028 165/135 |
| 2016/0109183 | A1* | 4/2016 | Yang | F28D 7/085 165/157 |
| 2016/0209129 | A1 | 7/2016 | Dietrich et al. | |
| 2017/0114960 | A1* | 4/2017 | Lee | F25J 1/004 |
| 2018/0194447 | A1* | 7/2018 | Lee | F25J 1/0025 |
| 2018/0216878 | A1* | 8/2018 | Tezuka | F25J 1/0297 |
| 2019/0310033 | A1* | 10/2019 | Li | F25B 39/00 |

FOREIGN PATENT DOCUMENTS

| | | | |
|---|---|---|---|
| JP | 59-055276 | U | 4/1984 |
| JP | 06-065775 | U | 9/1994 |
| JP | 2002-327991 | A | 11/2002 |
| JP | 2003-075024 | A | 3/2003 |
| JP | 2004-125340 | A | 4/2004 |
| JP | 2006-118795 | A | 5/2006 |
| JP | 2010-101617 | A | 5/2010 |
| JP | 3165331 | U | 1/2011 |
| JP | 2011-042824 | A | 3/2011 |
| JP | 2011-157979 | A | 8/2011 |
| JP | 2014-016083 | A | 1/2014 |
| JP | 2015-178944 | A | 10/2015 |
| JP | 2015-183905 | A | 10/2015 |
| JP | 2016-080279 | A | 5/2016 |
| JP | 2016-105022 | A | 6/2016 |
| JP | 2014-128737 | A | 7/2016 |
| JP | 2016-124385 | A | 7/2016 |
| JP | 2016-138606 | A | 8/2016 |
| JP | 2016-173184 | A | 9/2016 |
| JP | 2016-176534 | A | 10/2016 |
| KR | 10-1334002 | B1 | 11/2013 |
| KR | 20150133132 | A | 11/2015 |
| KR | 10-1599404 | B1 | 3/2016 |
| KR | 10-2016-0113493 | A | 9/2016 |
| KR | 10-2016-0128641 | B | 11/2016 |
| RU | 2016101068 | A | 7/2017 |
| WO | 2016/043184 | A1 | 3/2016 |
| WO | 2016/200089 | A1 | 12/2016 |

OTHER PUBLICATIONS

Office Action of U.S. Appl. No. 15/880,384—27 pages (dated Aug. 8, 2018).
Office Action of Korean Patent Application No. 10-2018-0007645—3 pages (dated Aug. 29, 2018).
Notice of Allowance of Japanese Patent Application No. 2017-236476—3 pages (dated Aug. 14, 2018).
Notice of Allowance of Japanese Patent Application No. 2018-009153 (dated May 15, 2018).
Search Opinion and Report of corresponding Danish Patent Application No. PA 2019 70481—9 pages (dated May 18, 2020).
Office Action of corresponding Russian Patent Application No. 2019122712/05(044355)—7 pages (dated Apr. 23, 2020).
Chinese Office Action from corresponding Chinese Patent Application No. 201880019102.4, dated Sep. 2, 2021.

* cited by examiner

【Fig. 1】
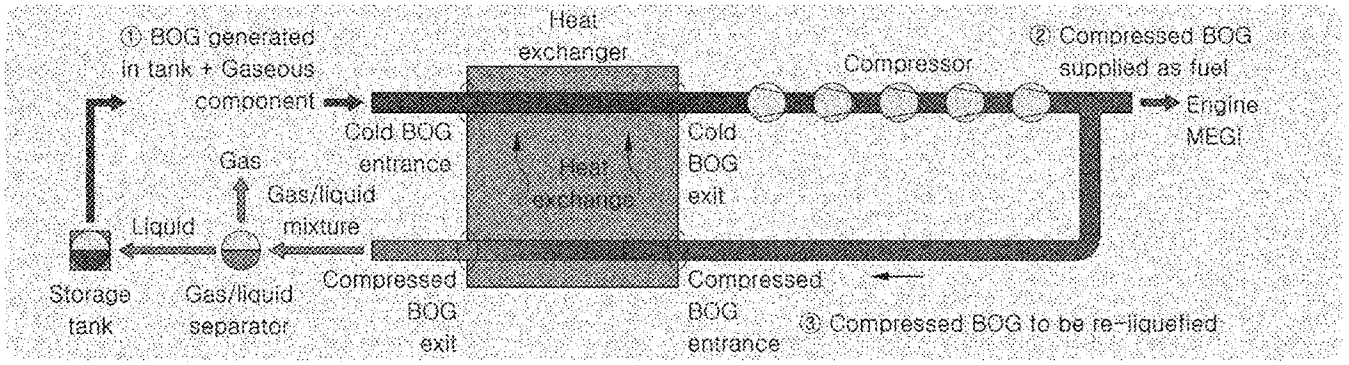

【Fig. 2a】
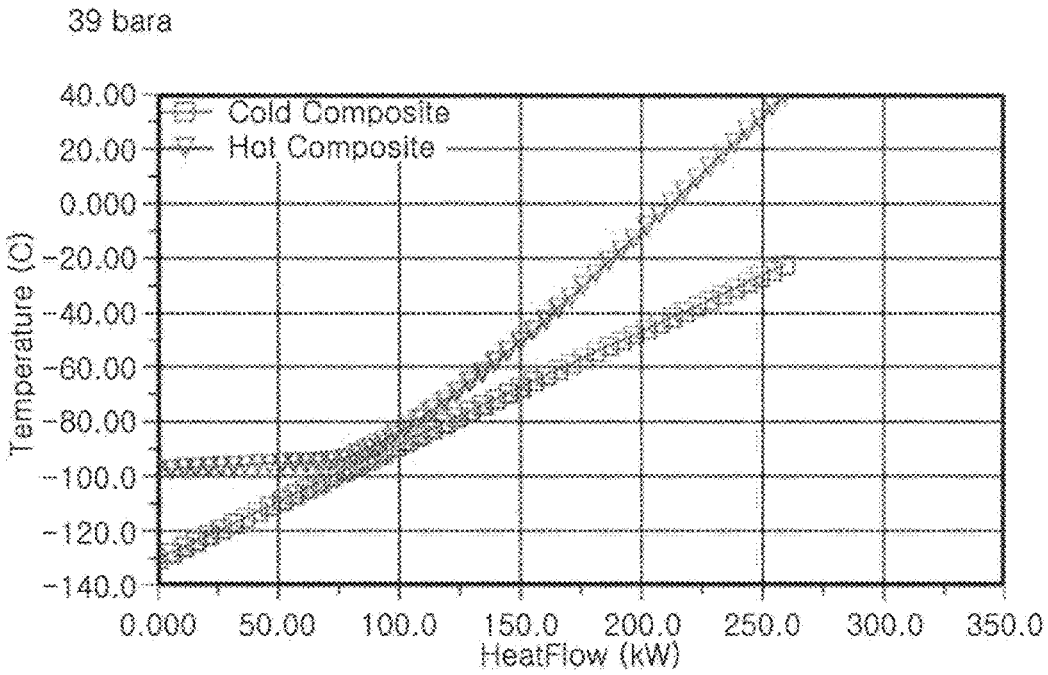
【Fig. 2b】
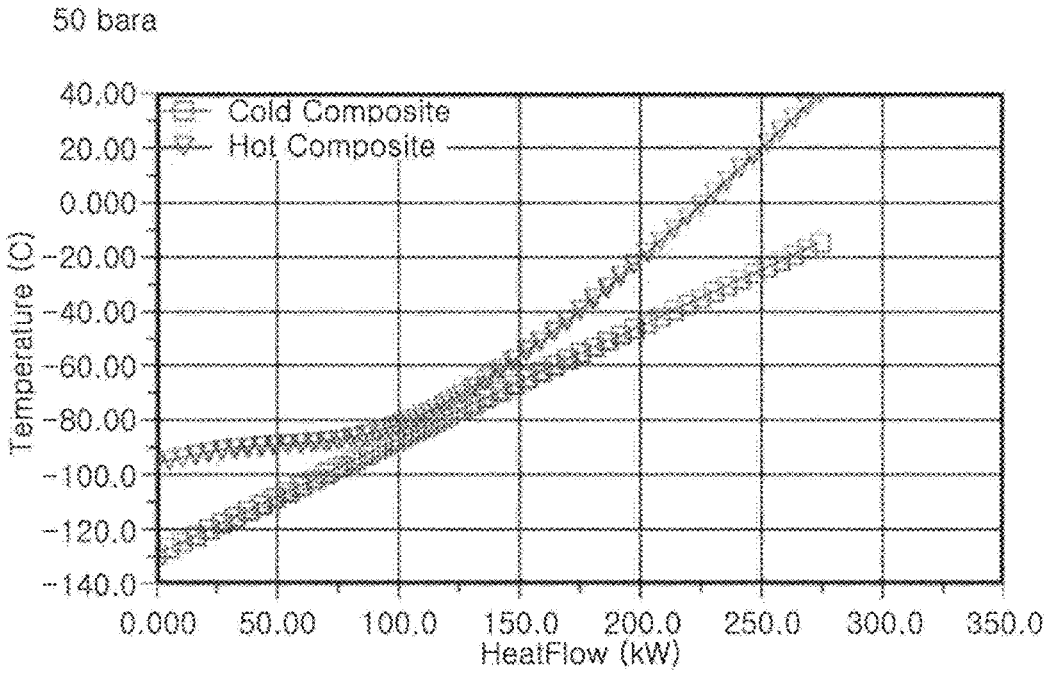

【Fig. 2c】
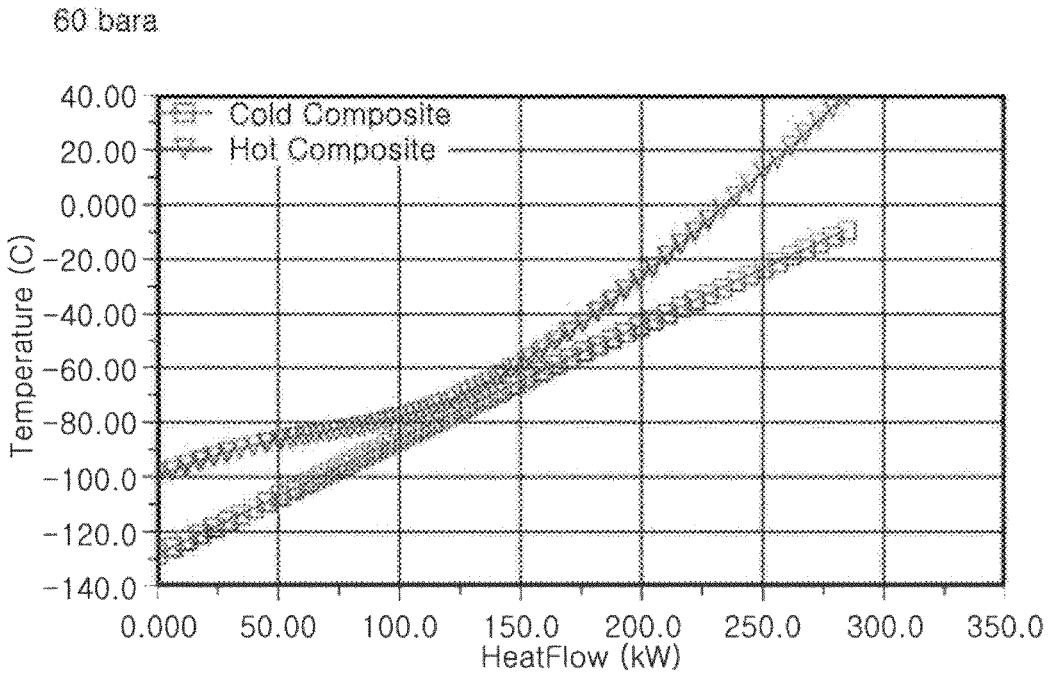
【Fig. 2d】
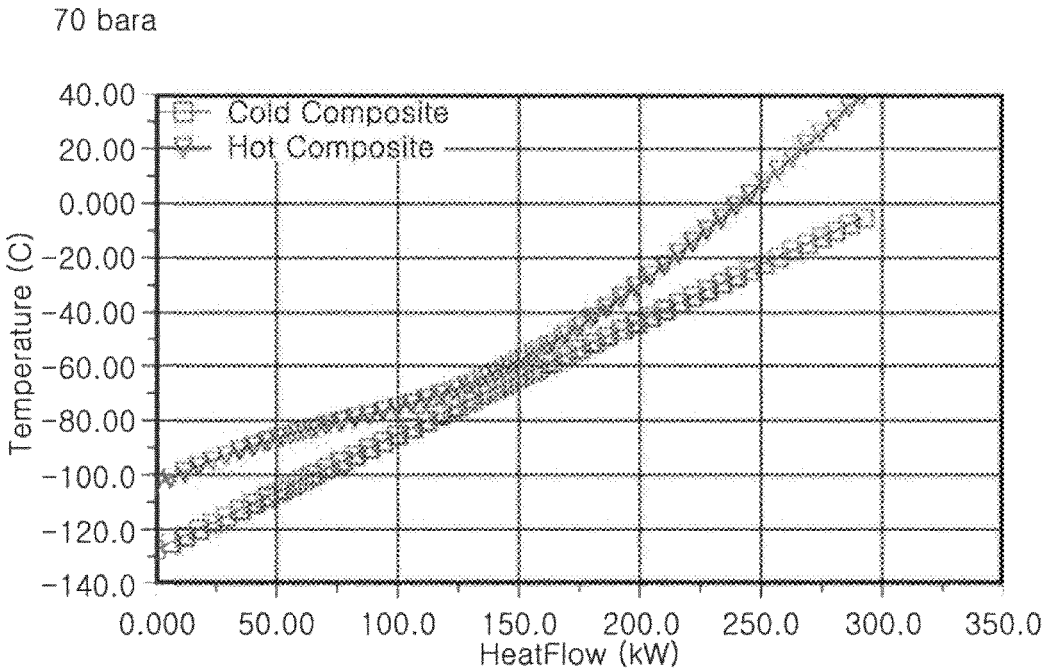

【Fig. 2e】
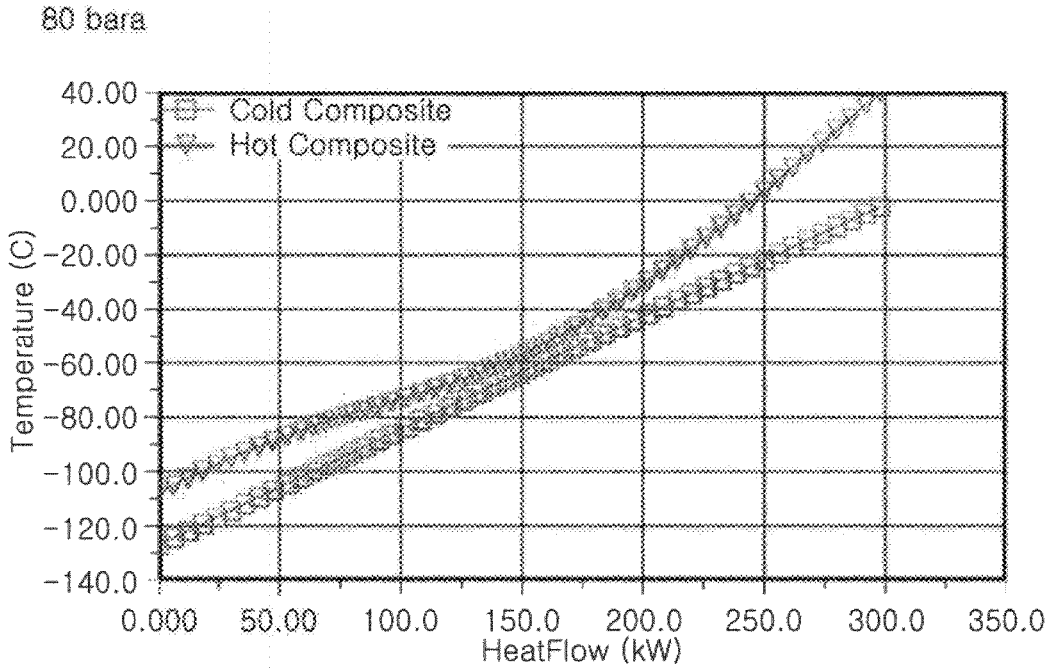
【Fig. 2f】
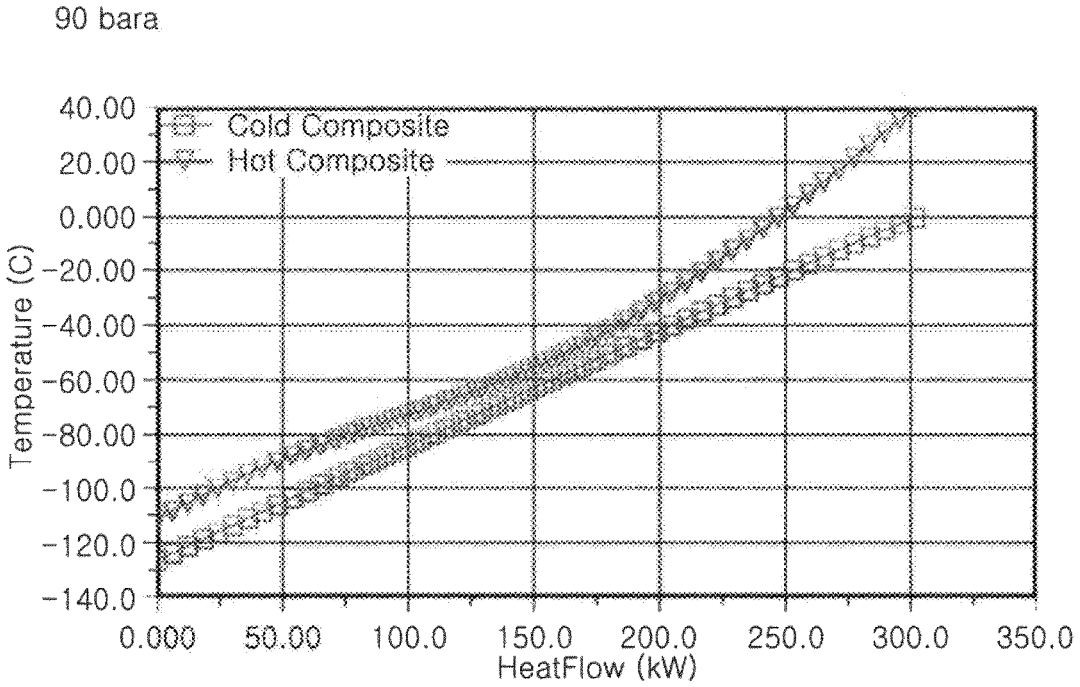

【Fig. 2g】
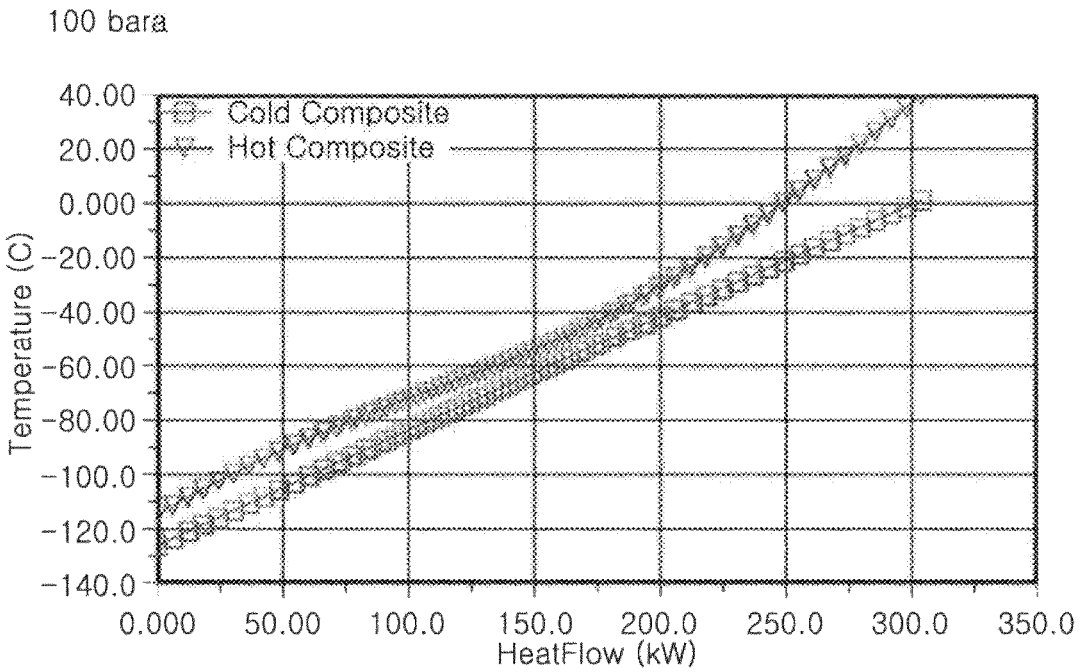
【Fig. 2h】
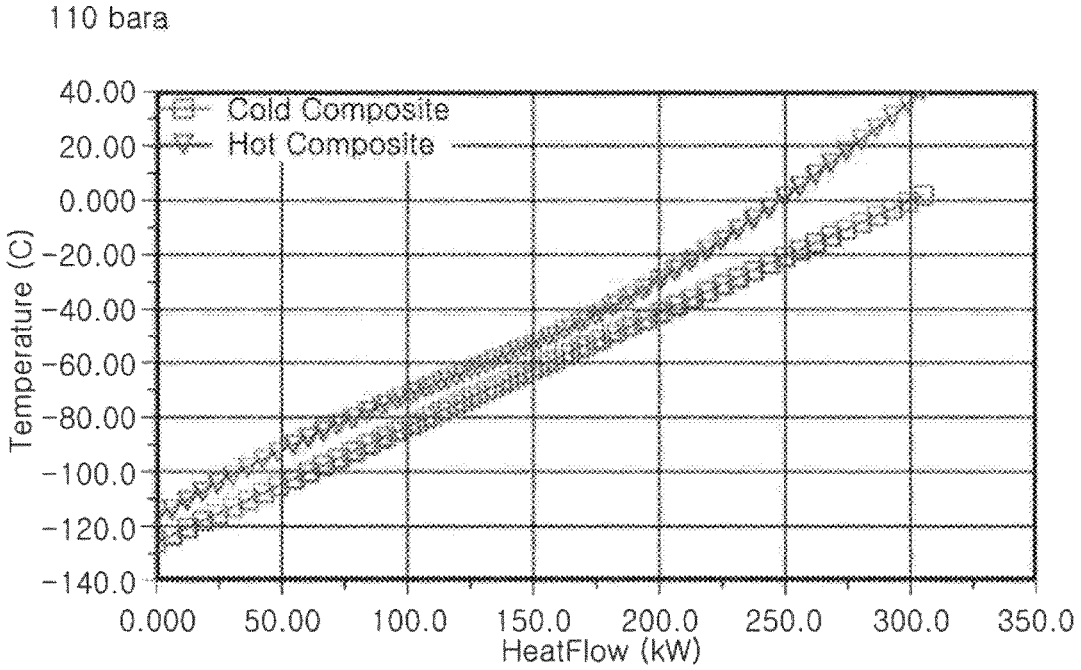

【Fig. 2i】
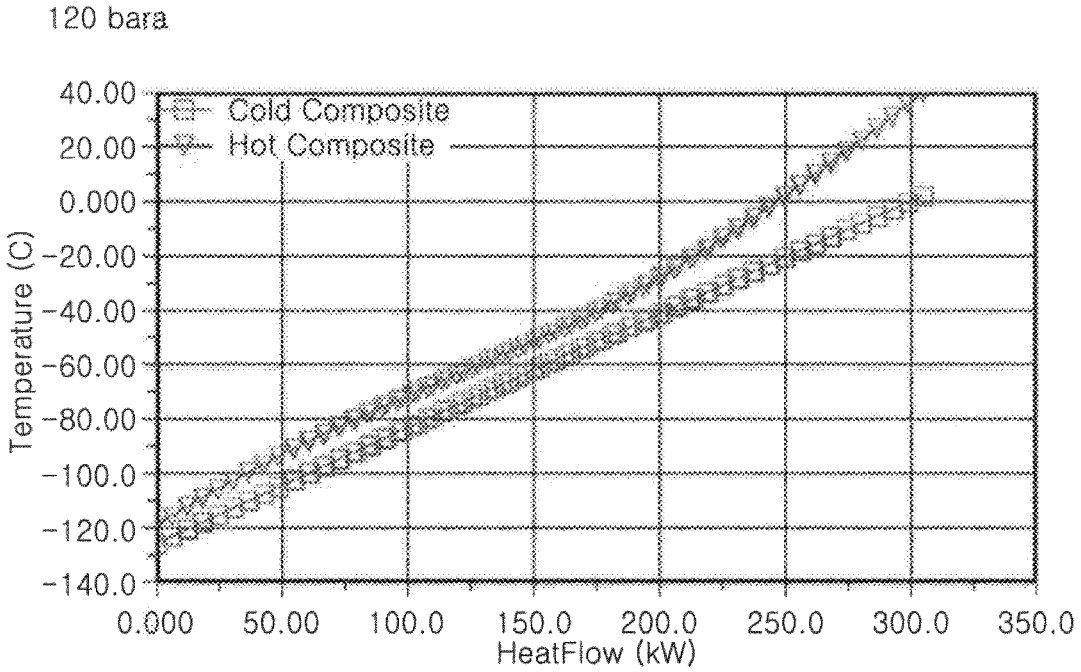
【Fig. 3a】
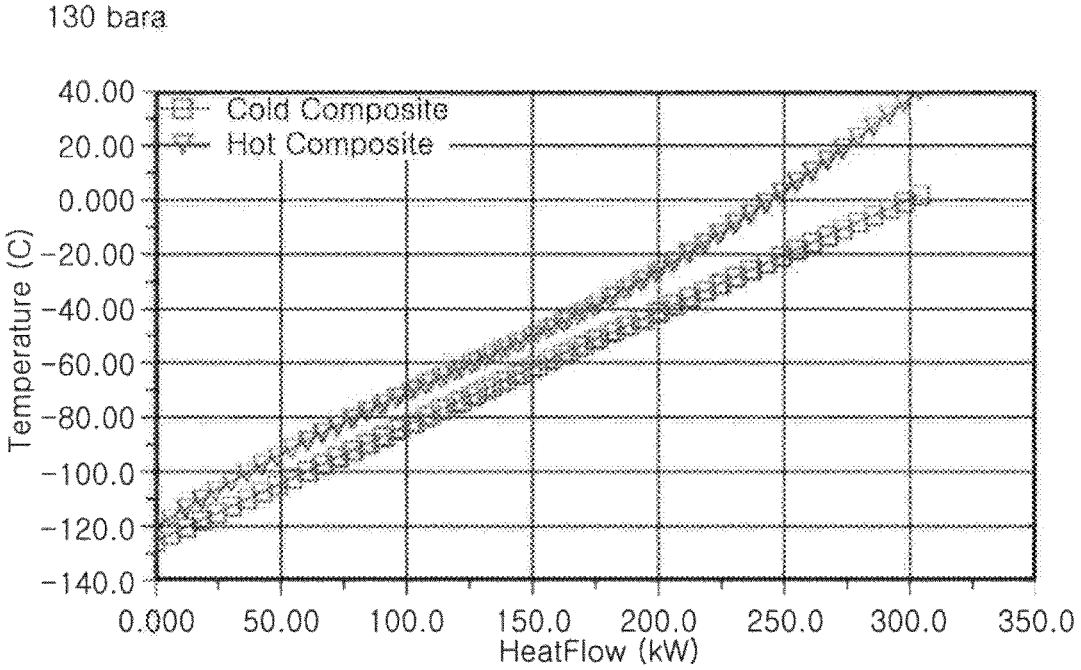

【Fig. 3b】
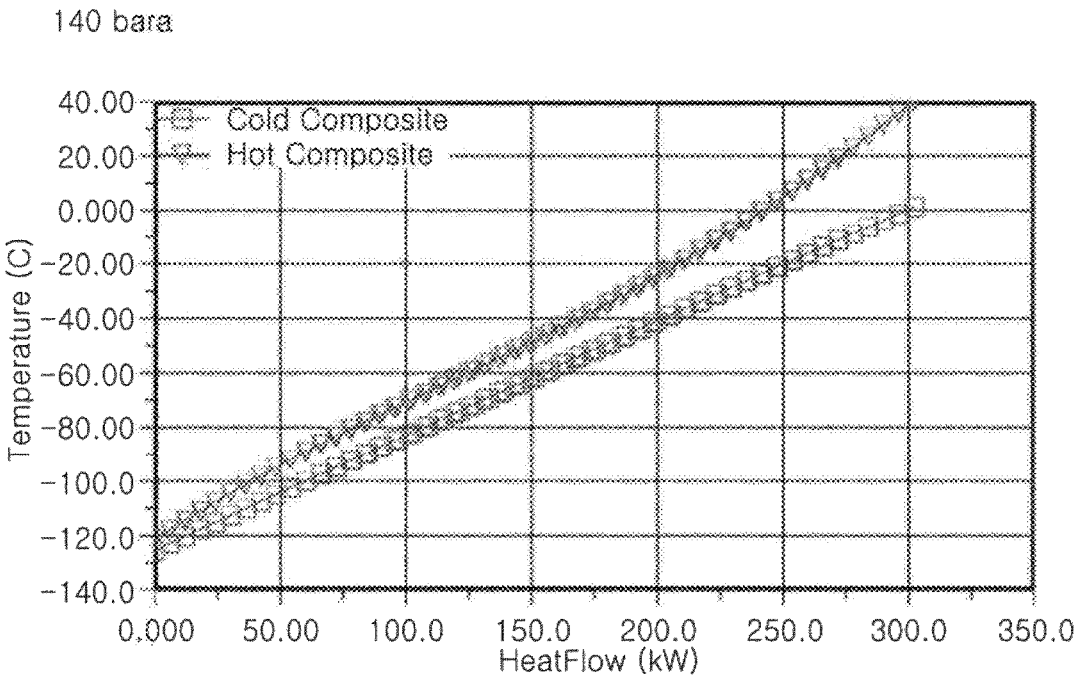
【Fig. 3c】
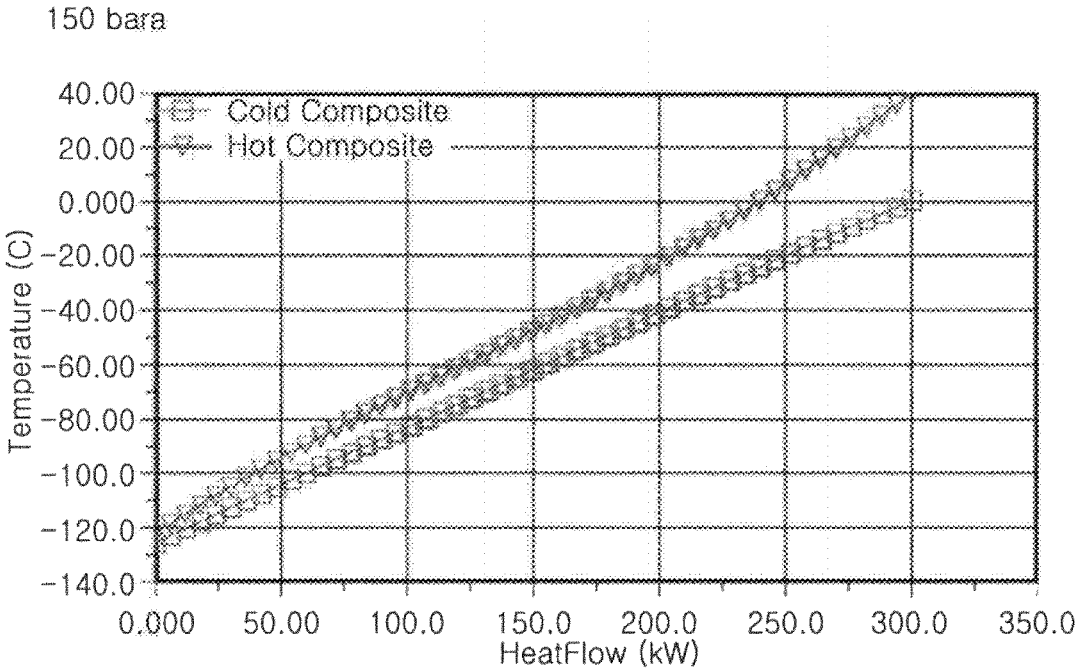

【Fig. 3d】
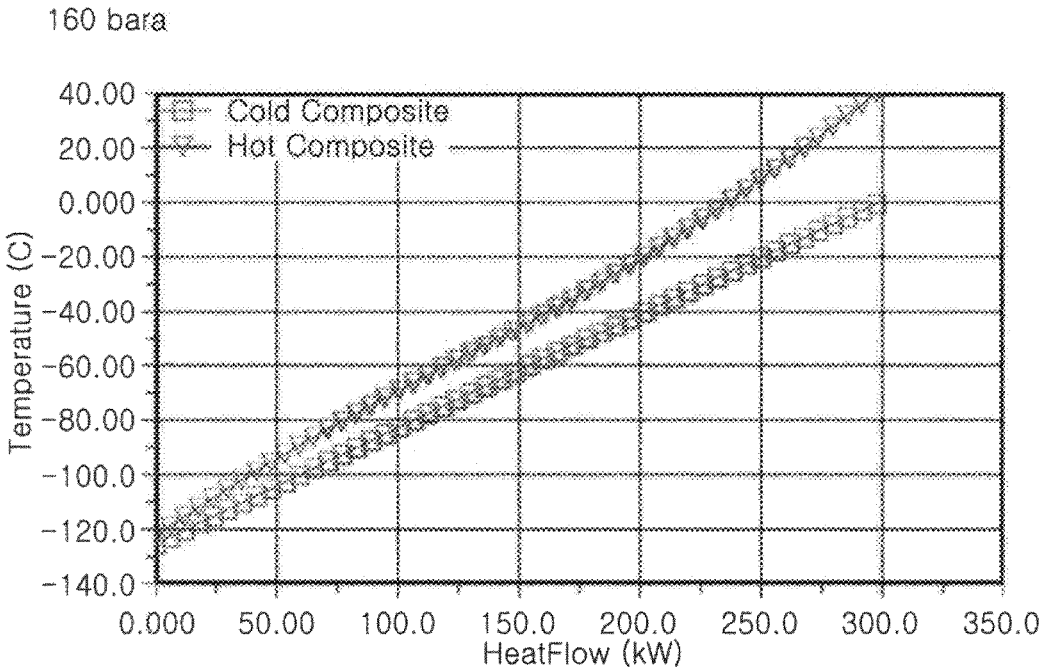
【Fig. 3e】
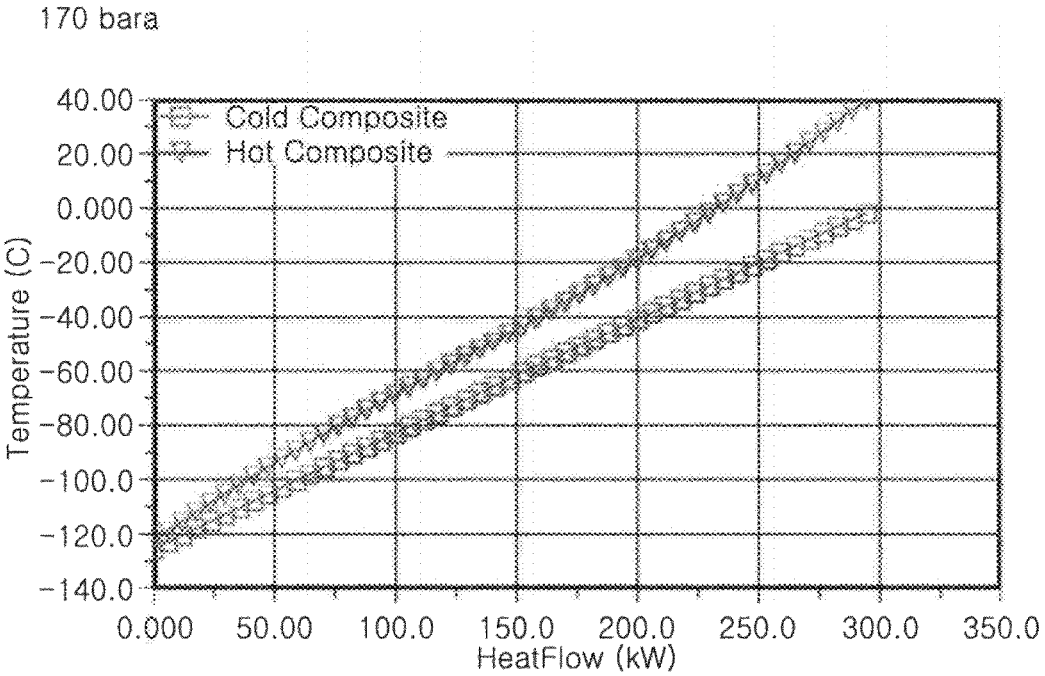

【Fig. 3f】
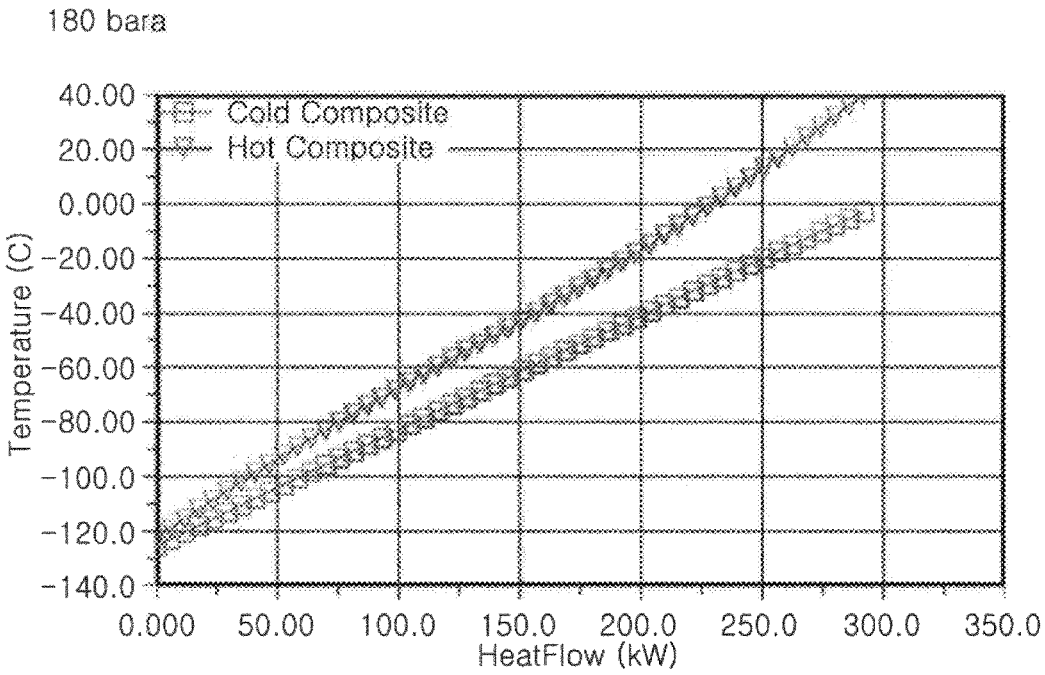
【Fig. 3g】
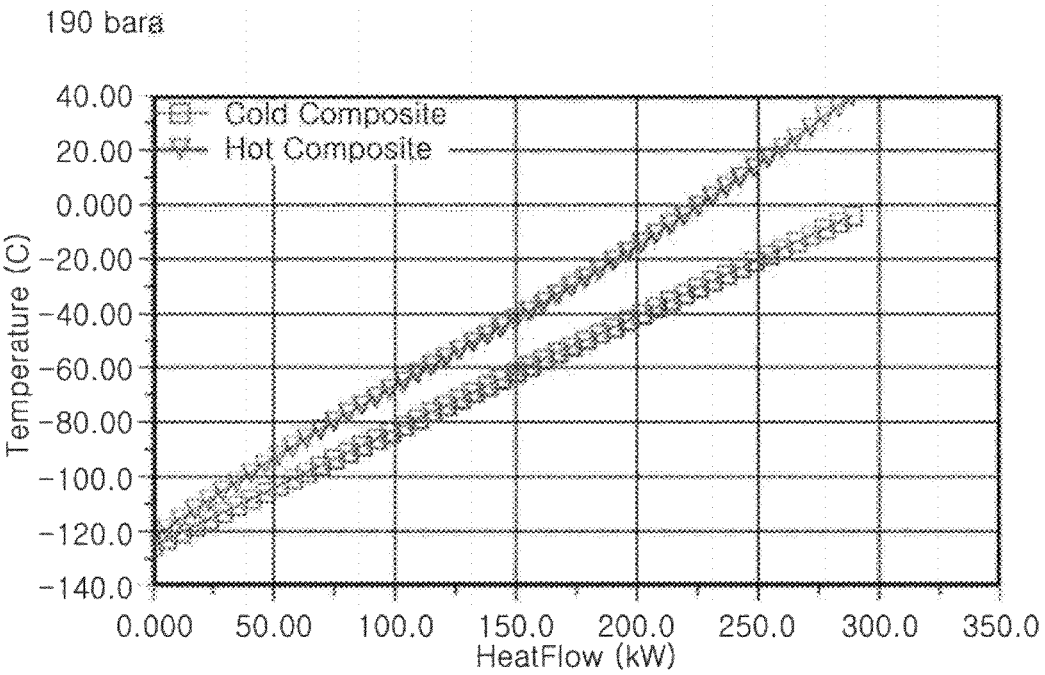

【Fig. 3h】
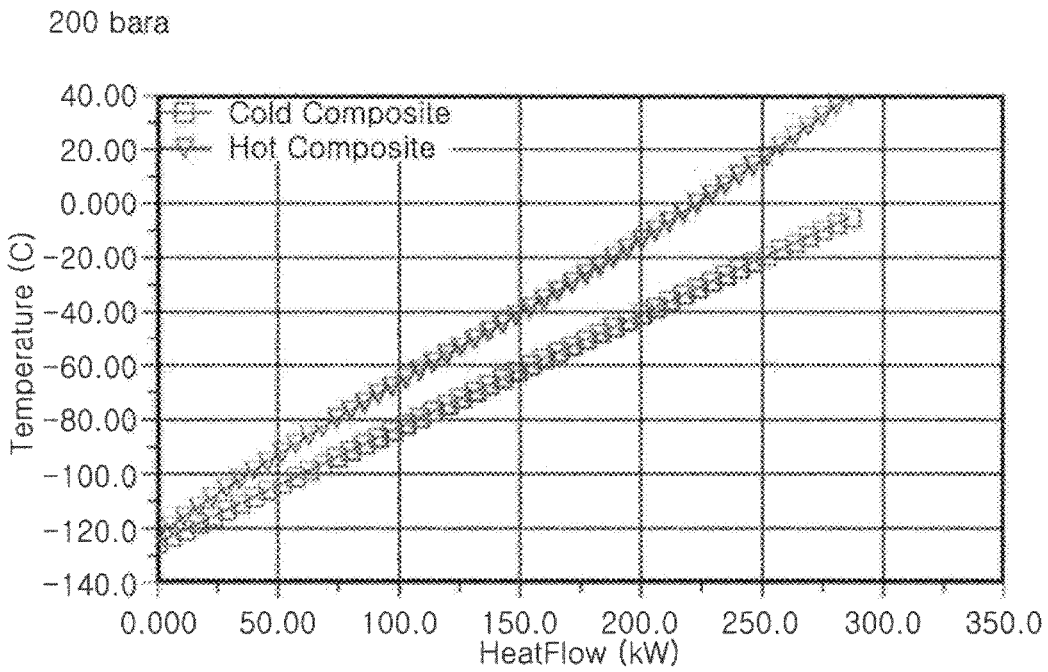
【Fig. 3i】
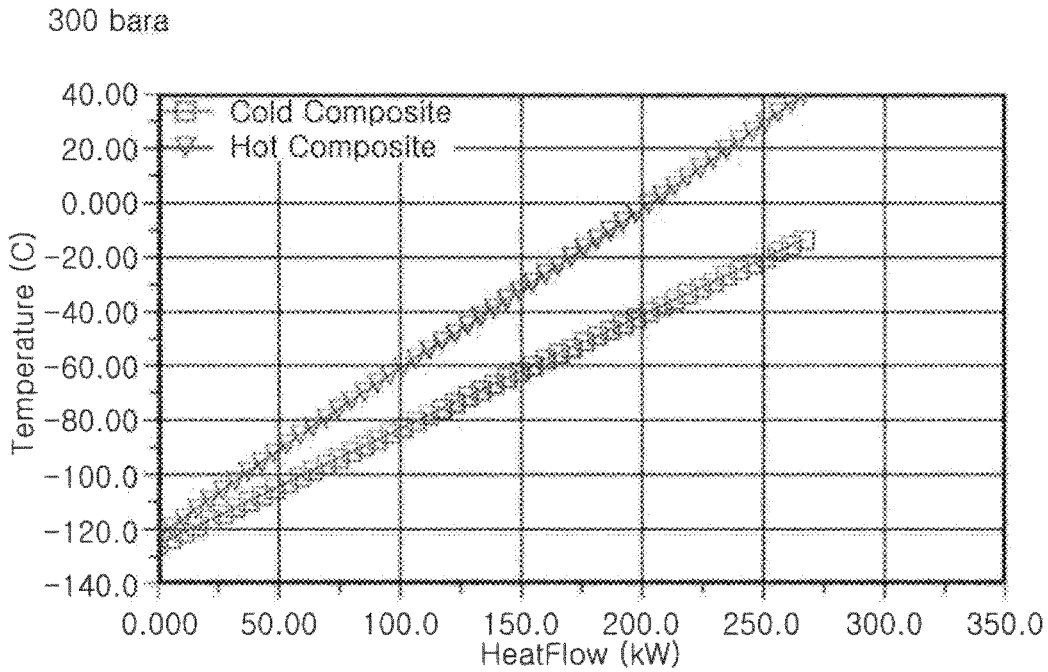

【Fig. 4】
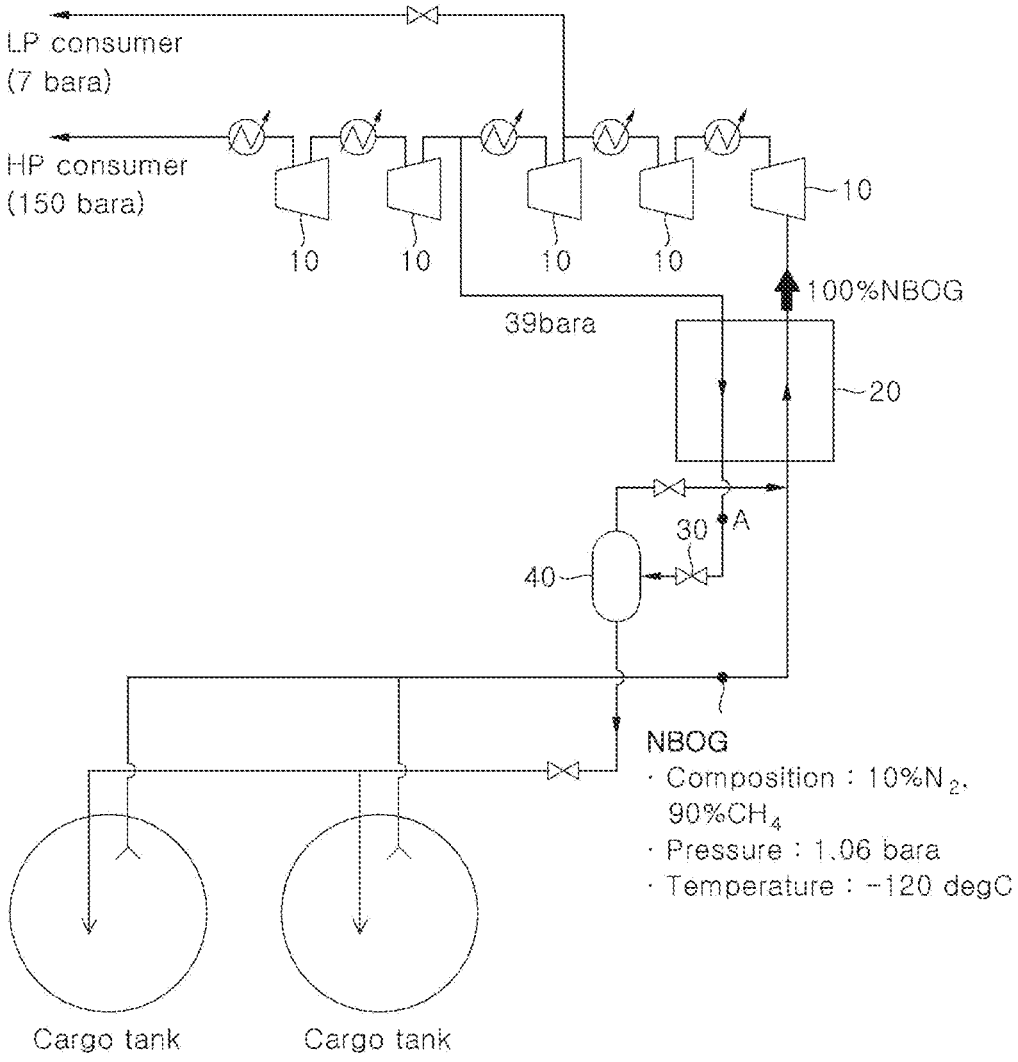

【Fig. 5】
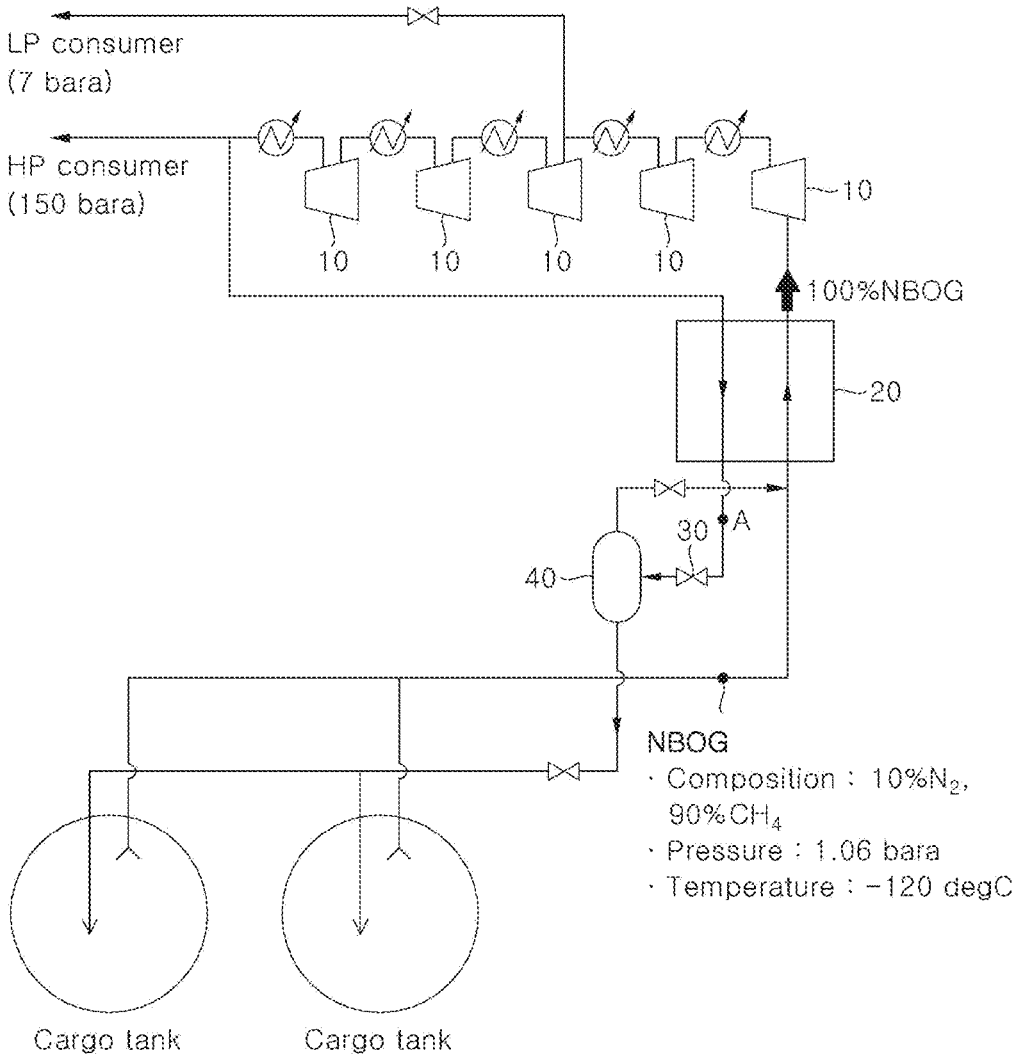

【Fig. 6】
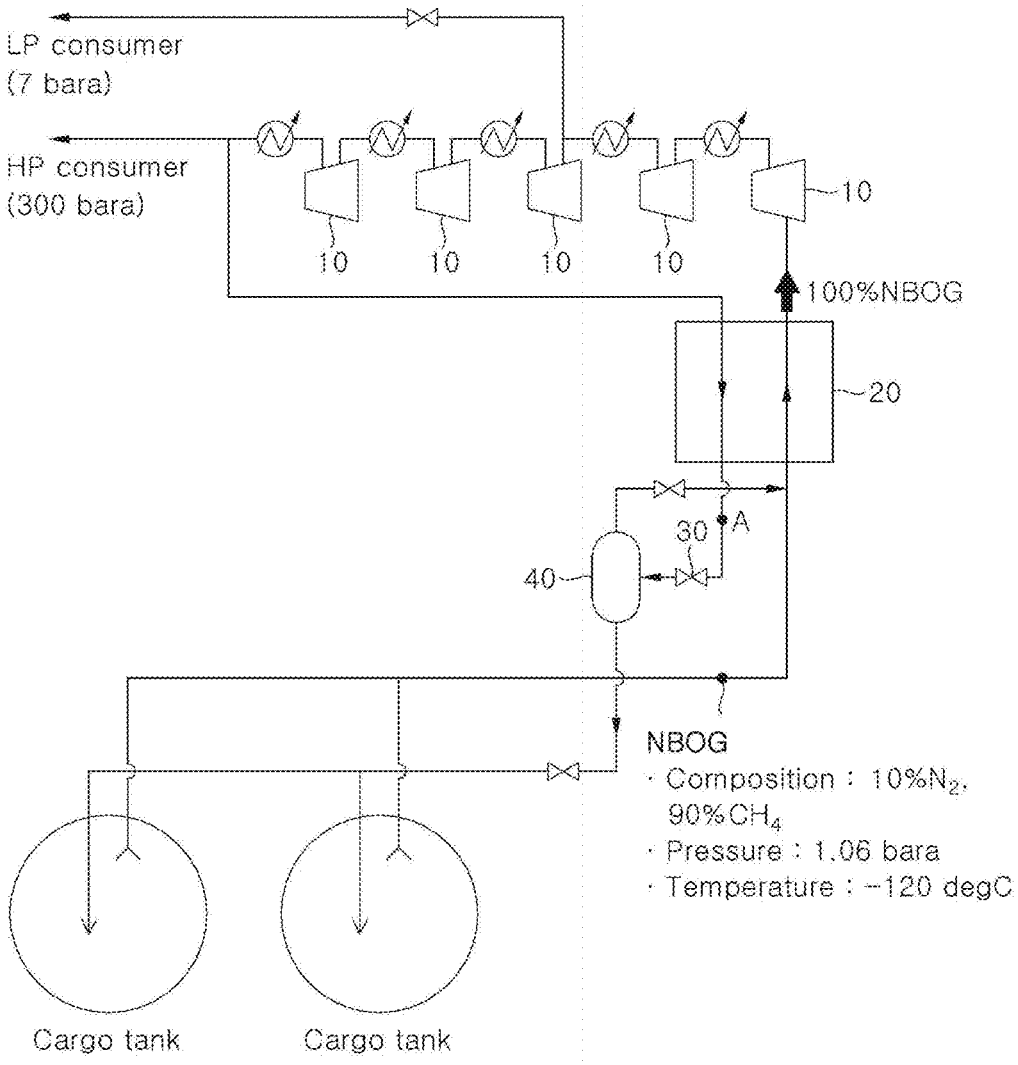

【Fig. 7】
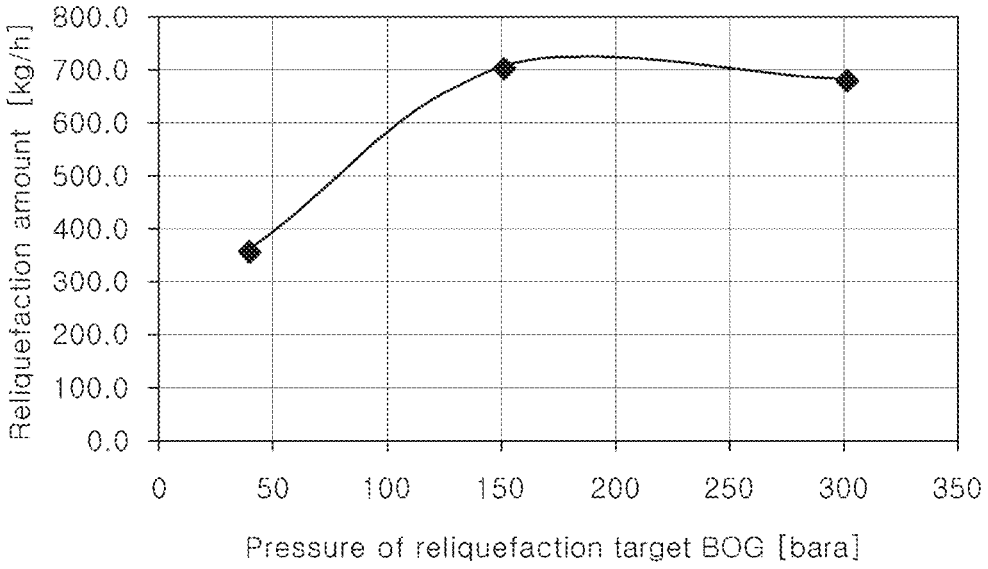

【Fig. 8】
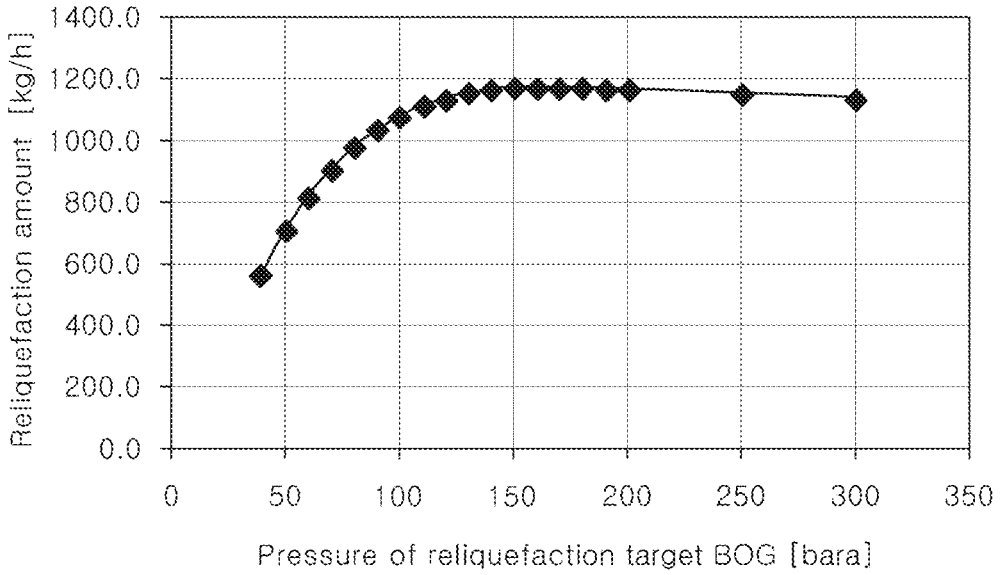

【Fig. 9】
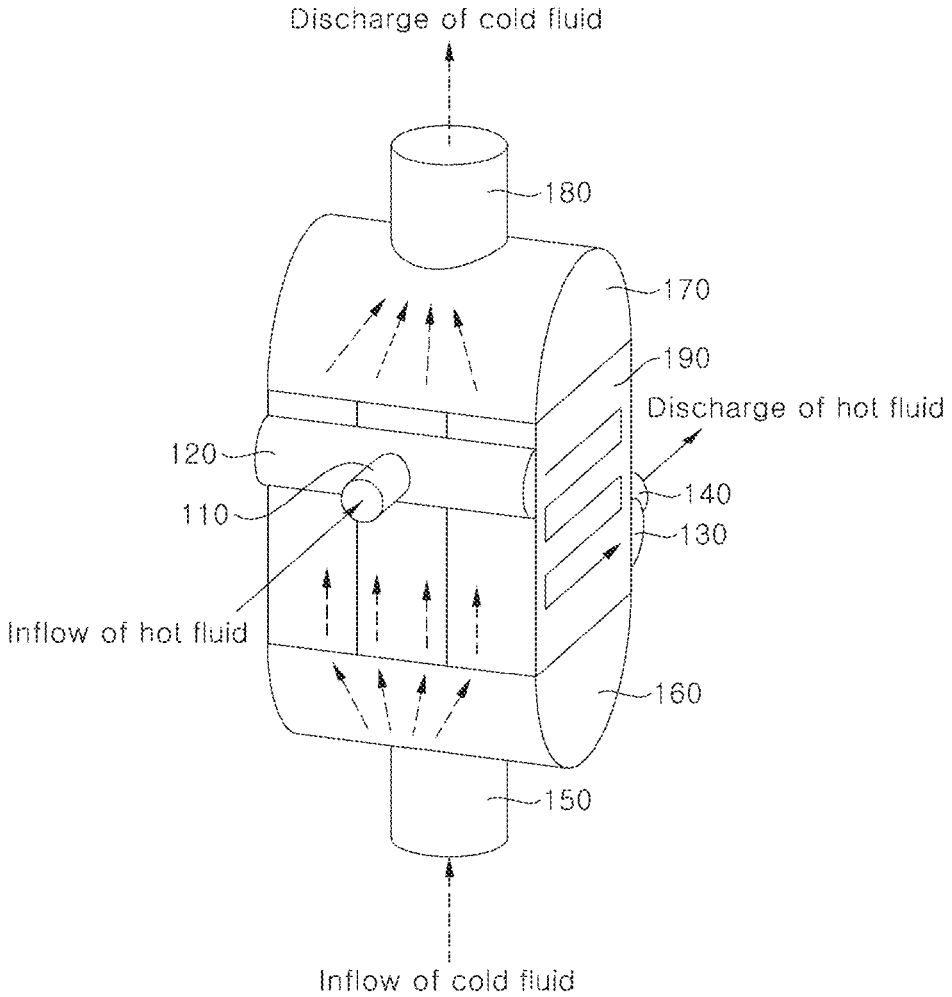

【Fig. 10】
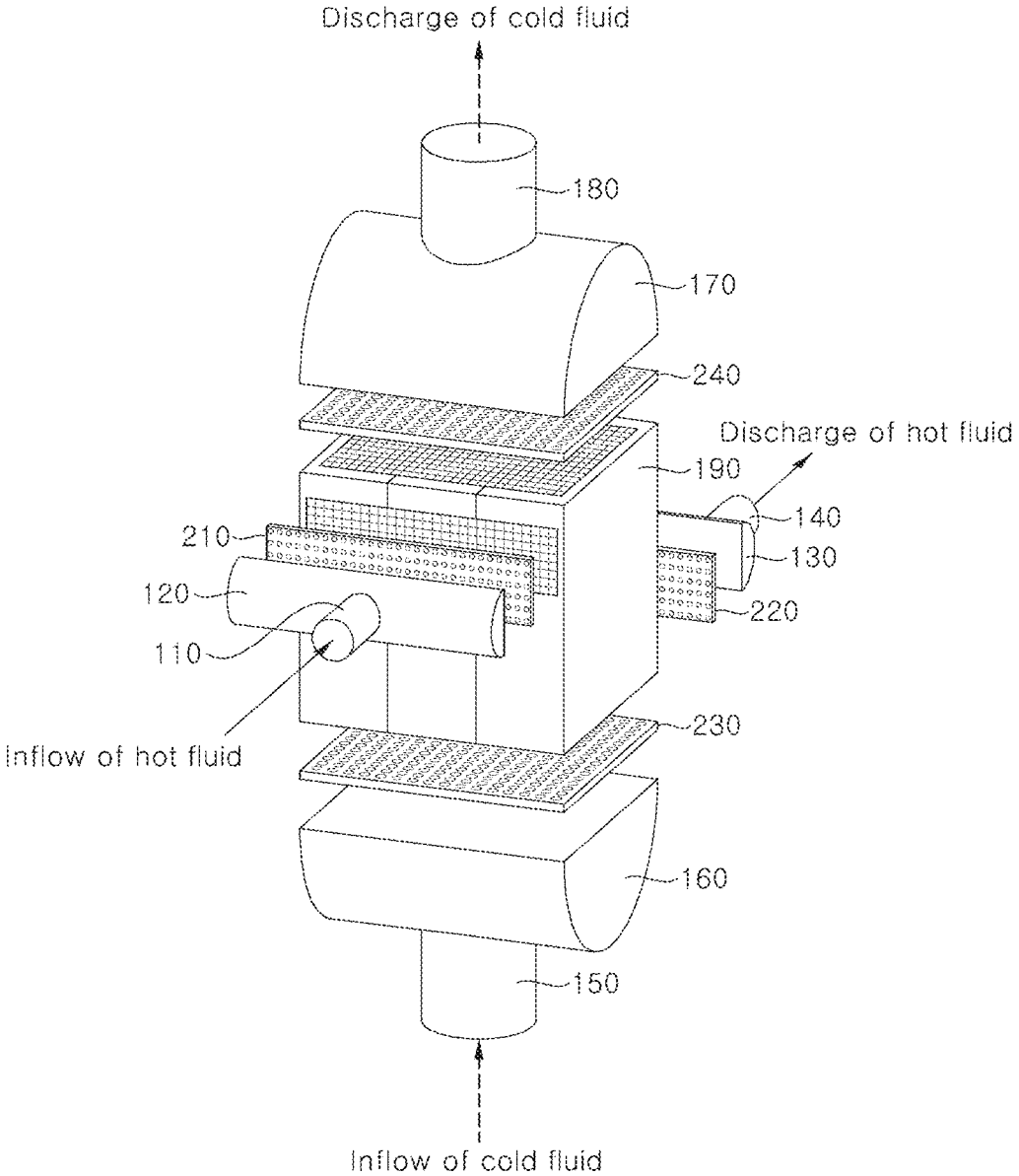

【Fig. 11】
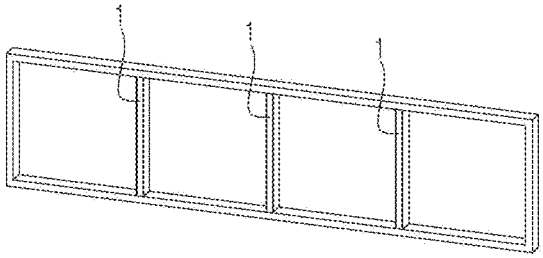
(a)
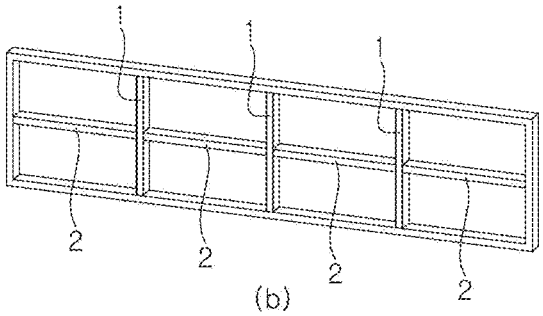
(b)
【Fig. 12】
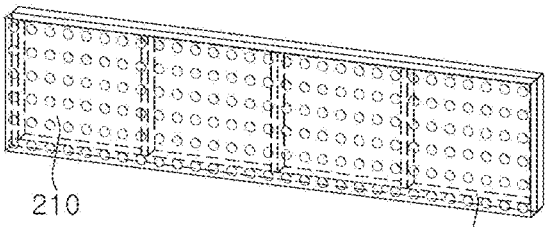
(a)
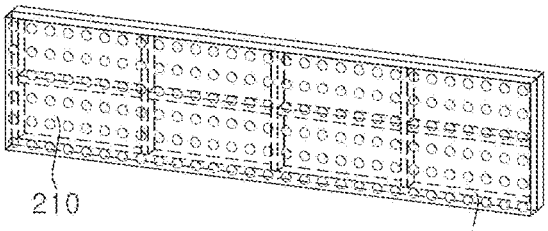
(b)

【Fig. 13】
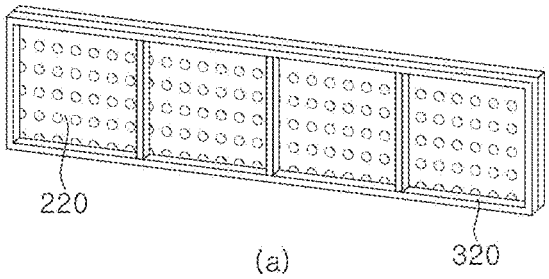
(a)
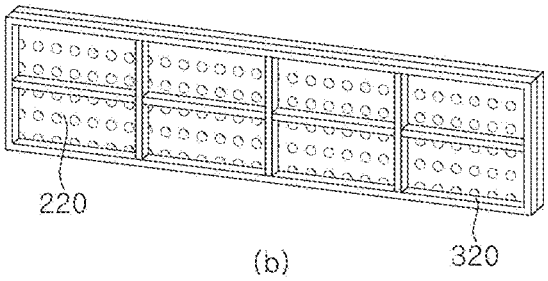
(b)

【Fig. 14】
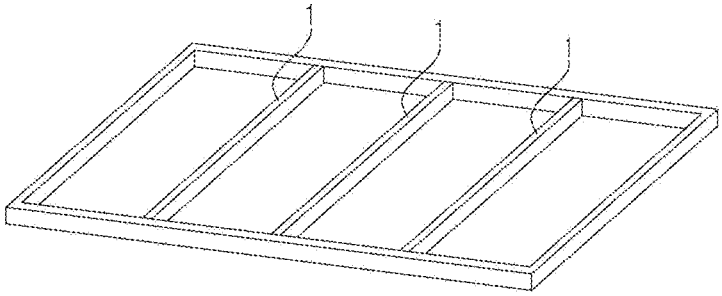
(a)
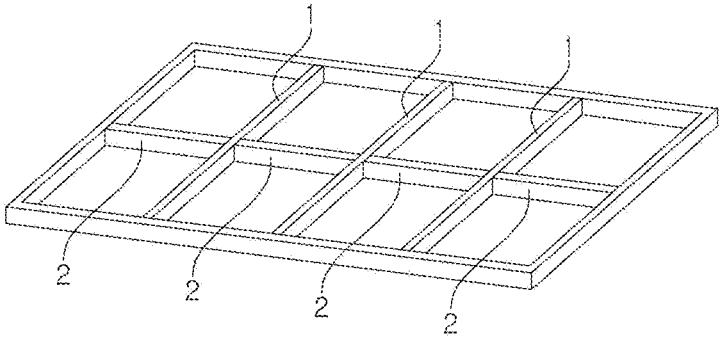
(b)

【Fig. 15】
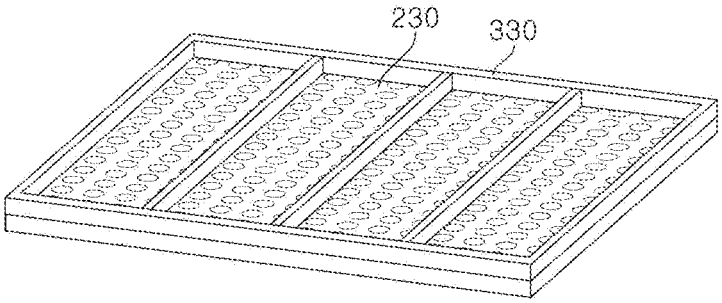
(a)
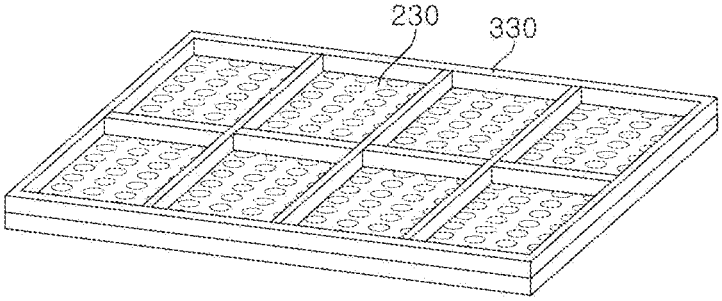
(b)

【Fig. 16】
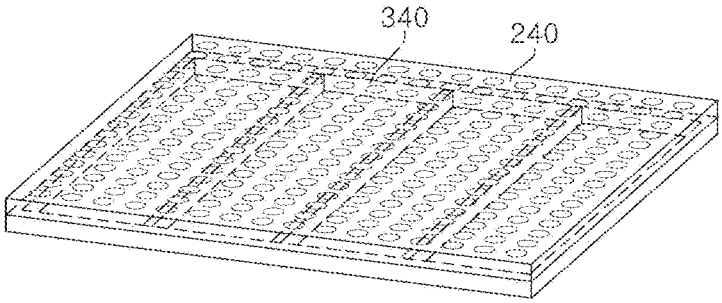
(a)
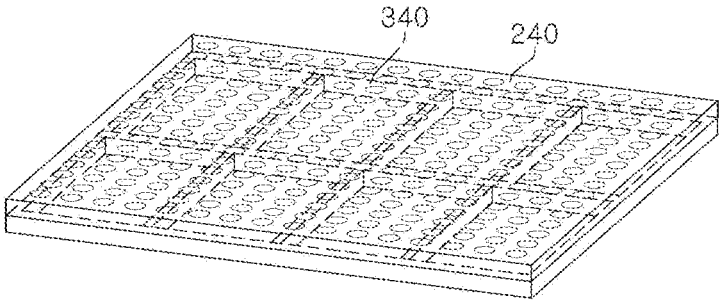
(b)

【Fig. 17】
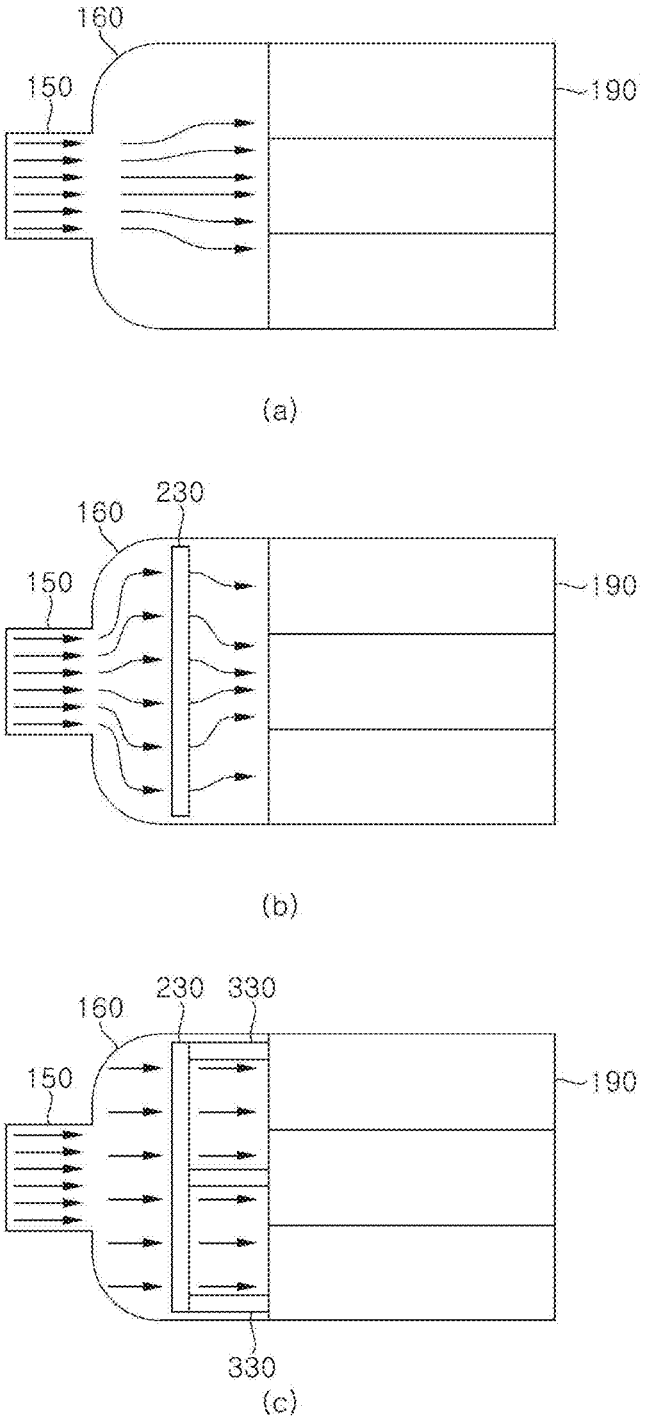

【Fig. 18】
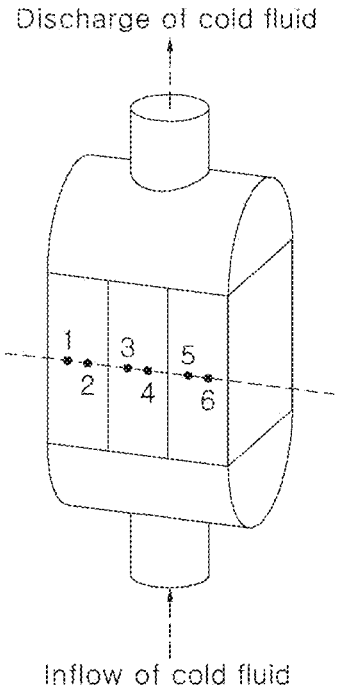
(a)
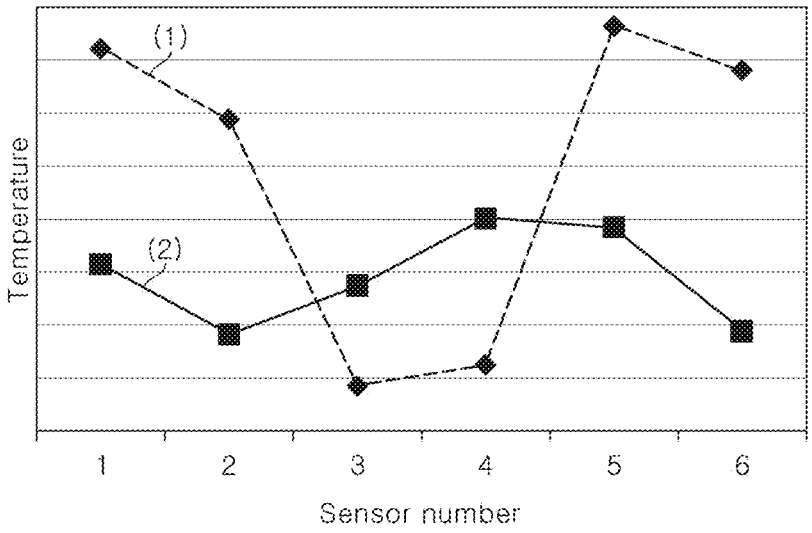
(b)

【Fig. 19】
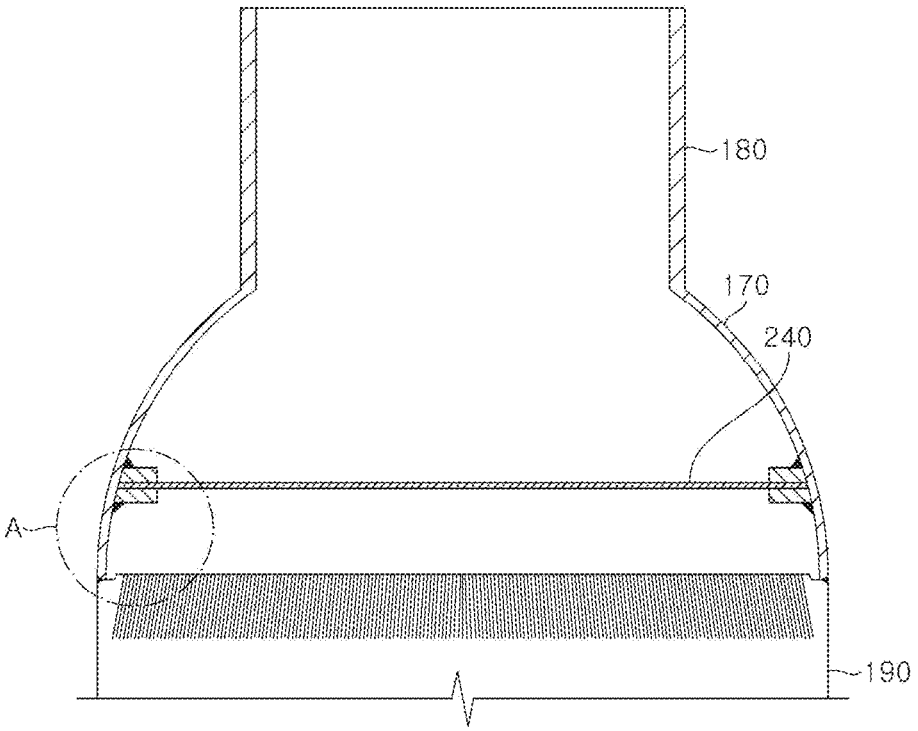
【Fig. 20】
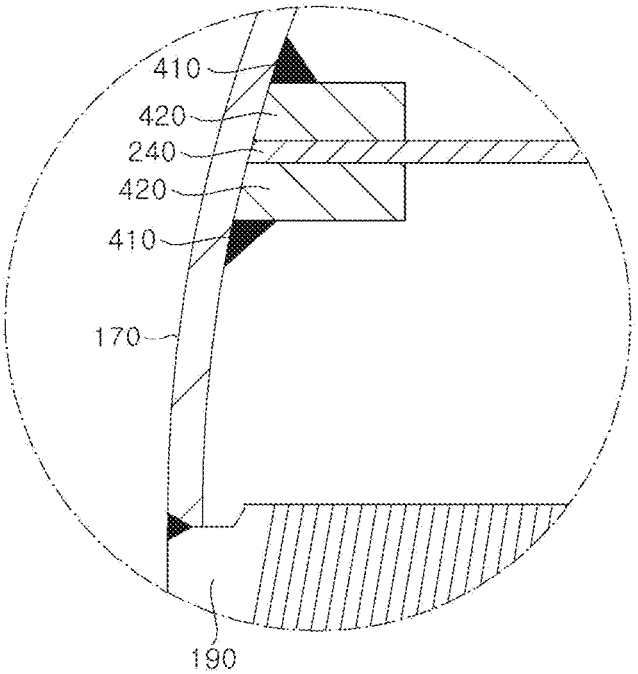

【Fig. 21】
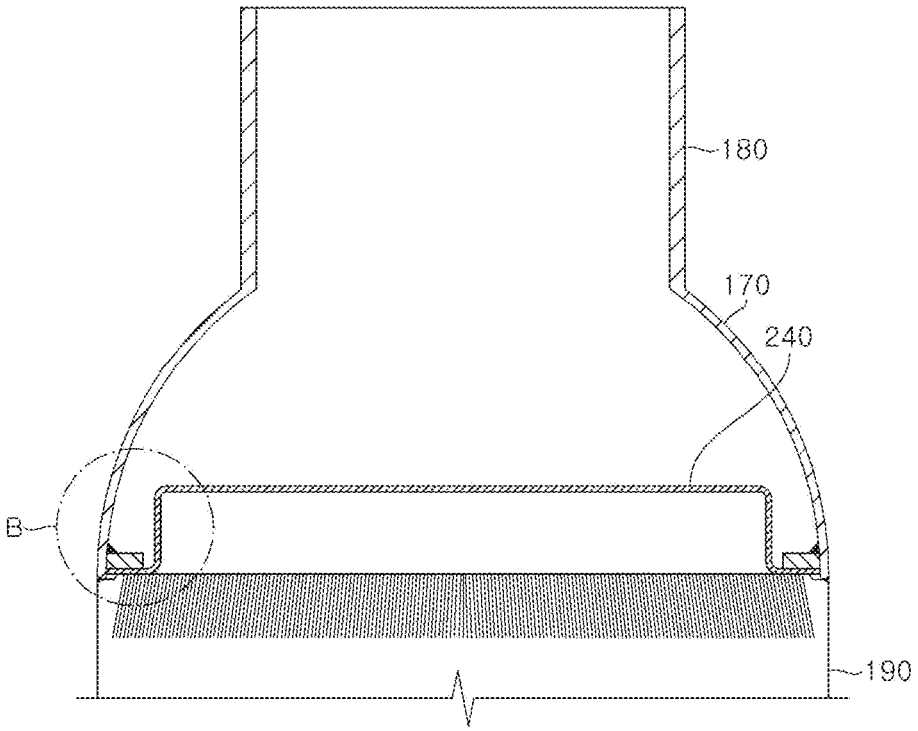
【Fig. 22】
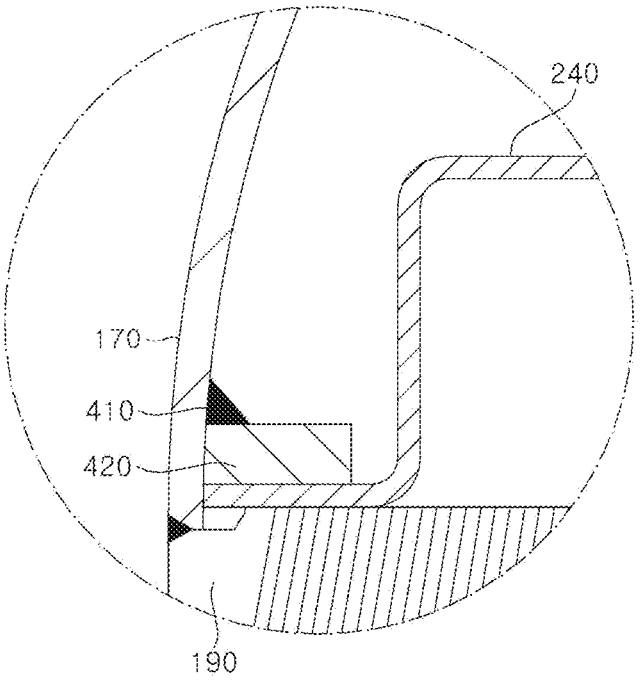

【Fig. 23】
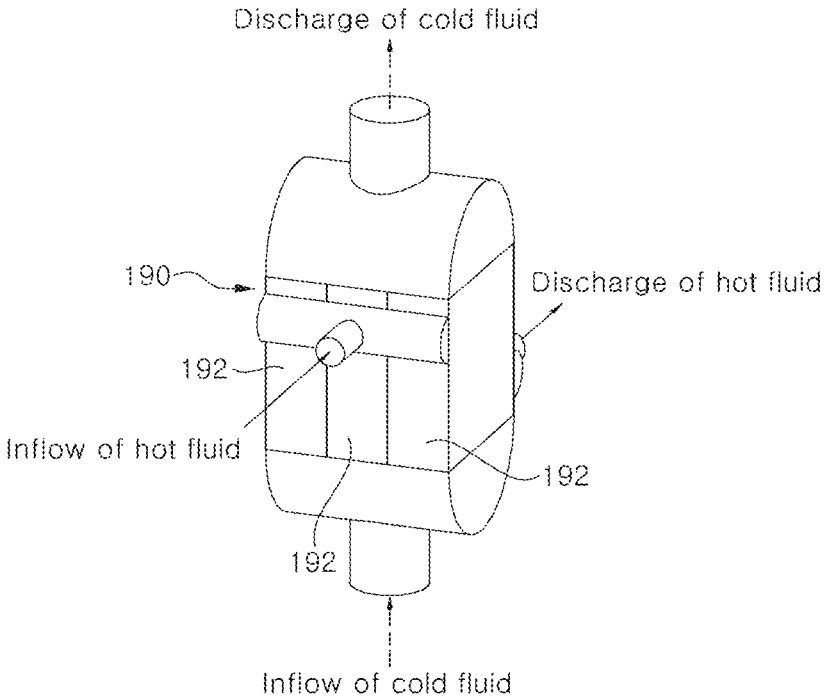
(a)
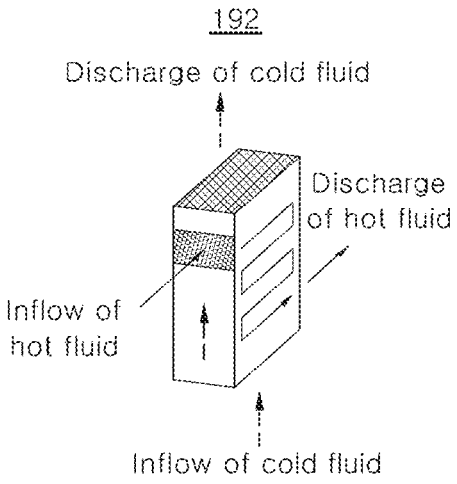
(b)
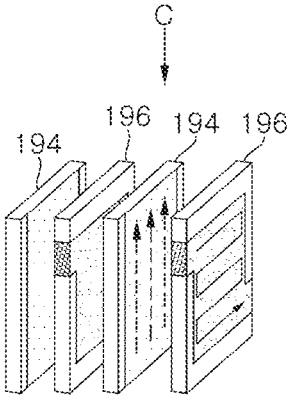
(c)

【Fig. 24】
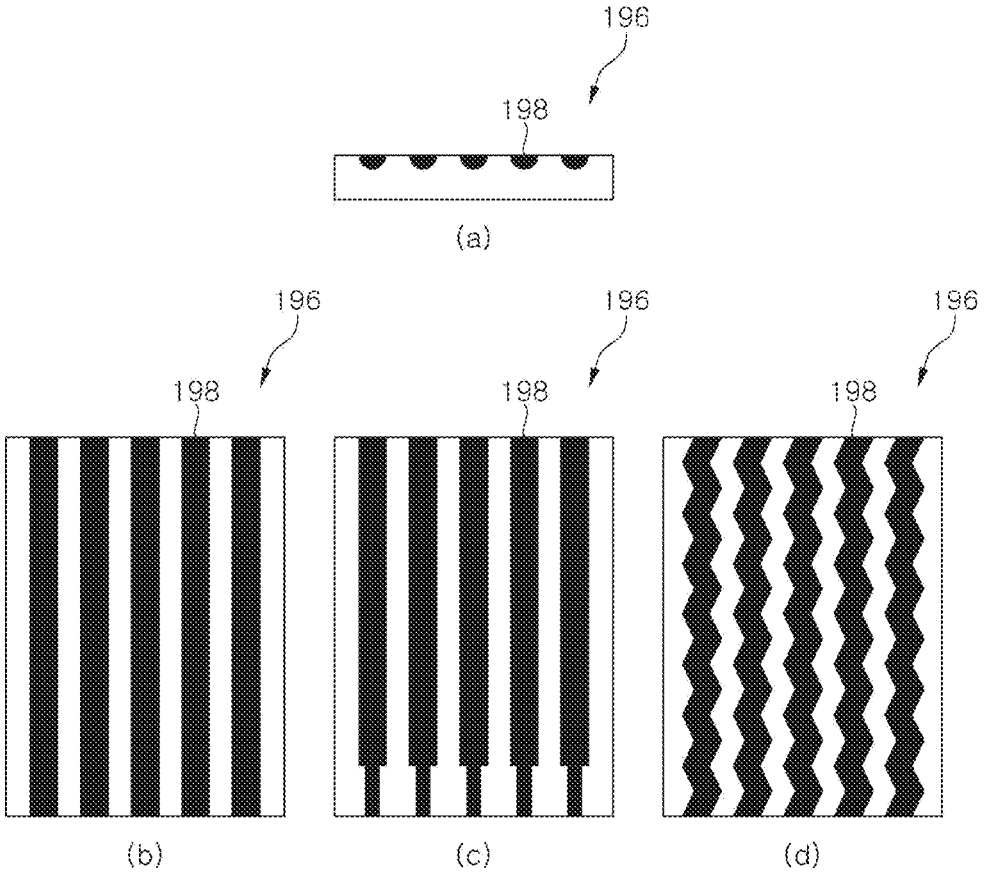

BOIL-OFF GAS RE-LIQUEFYING METHOD FOR LNG SHIP

TECHNICAL FIELD

The present invention relates to a boil-off gas reliquefaction method in which, among boil-off gas generated in a storage tank of a liquefied natural gas (LNG) ship to be supplied as fuel to an engine, surplus boil-off gas above fuel requirement of the engine is re-liquefied using the boil-off gas as a refrigerant.

BACKGROUND

Recently, consumption of liquefied gas such as liquefied natural gas (LNG) has been rapidly increasing worldwide. Liquefied gas obtained by cooling natural gas to an extremely low temperature has a much smaller volume than natural gas and thus is much more suitable for storage and transportation. In addition, liquefied gas such as LNG is an eco-friendly fuel that has low air pollutant emissions upon combustion, since air pollutants in natural gas can be reduced or removed during a liquefaction process.

LNG is a colorless and transparent liquid obtained by cooling natural gas mainly composed of methane to about −163° C. to liquefy natural gas and has a volume of about 1/600 that of natural gas. Thus, liquefaction of natural gas enables very efficient transportation.

However, since natural gas is liquefied at an extremely low temperature of −163° C. under normal pressure, LNG can easily evaporate with a small change in temperature. Although an LNG storage tank is insulated, external heat is continuously transferred to the storage tank, causing LNG in transit to naturally evaporate, thereby generating BOG (BOG).

Generation of BOG means a loss of LNG and thus has a great influence on transportation efficiency. In addition, when BOG accumulates in a storage tank, there is a risk that the pressure inside the storage tank will excessively rise, causing damage to the tank. Various studies have been conducted to treat BOG generated in an LNG storage tank. Recently, for treatment of BOG, there has been proposed a method in which BOG is re-liquefied to be returned to an LNG storage tank, a method in which BOG is used as an energy source in a source of fuel consumption such as a marine engine, and the like.

Examples of a method for reliquefaction of BOG include a method of using a refrigeration cycle with a separate refrigerant in which BOG is allowed to exchange heat with the refrigerant to be re-liquefied and a method of using BOG as a refrigerant to re-liquefy BOG without any separate refrigerant. Particularly, a system employing the latter method is called a partial reliquefaction system (PRS).

Examples of a marine engine capable of being fueled by natural gas include gas engines such as a DFDE engine, an X-DF engine, and an ME-GI engine.

A DFDE engine has four strokes per cycle and uses an Otto cycle in which natural gas having a relatively low pressure of about 6.5 bar is injected into a combustion air inlet, followed by pushing a piston upward to compress the gas.

An X-DF engine has two strokes per cycle and uses an Otto cycle using natural gas having a pressure of about 16 bar as fuel.

An ME-GI engine has two strokes per cycle and uses a diesel cycle in which natural gas having a high-pressure of about 300 bar is injected directly into a combustion chamber in the vicinity of the top dead center of a piston.

SUMMARY

Embodiments of the present invention provide a BOG reliquefaction method which can exhibit stabilized reliquefaction performance, thereby increasing overall reliquefaction efficiency and reliquefaction amount.

In accordance one aspect of the present invention, a BOG reliquefaction s method for LNG ship includes: 1) compressing BOG; 2) cooling the BOG compressed in Step 1) through heat exchange between the compressed BOG and a refrigerant using a heat exchanger; 3) expanding the BOG cooled in Step 2); and 4) stably maintaining reliquefaction performance regardless of change in flow rate of the BOG compressed in Step 1) and supplied to the heat exchanger to be used as a reliquefaction target.

The reliquefaction performance is stably maintained even when the heat exchanger has a heat capacity ratio of 0.7 to 1.2.

An amount of the BOG reliquefied through Steps 1) to 3) is maintained at 50% or more of an HYSYS calculation value.

The BOG reliquefaction s method for LNG ships further include: 5) separating a fluid expanded in Step 3) into a gaseous component and a liquid component.

The gaseous component separated in Step 5) is combined with BOG to be used as the refrigerant for heat exchange in Step 2).

The LNG ship is operated at a speed of 10 to 17 knots.

Some fraction of the BOG compressed in Step 1) is used as fuel of an engine, and a flow rate of the BOG used as the fuel of the engine is in the range of 1,100 kg/h to 2,660 kg/h.

The engine comprises a propulsion engine and a power generation engine.

The flow rate of the BOG to be used as the reliquefaction target is in the range of 1,900 kg/h to 3,300 kg/h.

A ratio of the flow rate of the BOG to be used as the reliquefaction target to the flow rate of BOG used as the refrigerant for heat exchange in Step 2) is in the range of 0.42 to 0.72.

The BOG compressed in Step 1) and not sent to the engine is additionally compressed and sent to the heat exchanger.

In accordance another aspect of the present invention, a BOG reliquefaction method for LNG ship, includes: 1) compressing BOG; 2) cooling the BOG compressed in Step 1) through heat exchange using BOG as a refrigerant; 3) expanding the BOG cooled in Step 2); and 4) stably maintaining reliquefaction performance regardless of change in flow rate of the BOG used as the refrigerant for heat exchange in Step 2).

An amount of the BOG reliquefied through Steps 1) to 3) is maintained at 50% or more of an HYSYS calculation value.

The BOG reliquefaction method may further include 5) separating a fluid expanded in Step 3) into a gaseous component and a liquid component, wherein the gaseous component separated in Step 5) is combined with BOG to be used as the refrigerant for heat exchange in Step 2).

In accordance another aspect of the present invention, a BOG reliquefaction method for an LNG ship having a high-pressure gas injection engine, includes: compressing BOG discharged from a storage tank to high pressure and forcing all or some fraction of the high-pressure compressed BOG to exchange heat with BOG discharged from the storage tank by a heat exchanger; and reducing the pressure of the heat-exchanged high-pressure compressed BOG, the method further include: stably maintaining reliquefaction performance regardless of change in operating conditions of the LNG ship or change in flow rate of BOG to be used as a reliquefaction target.

The reliquefaction performance is stably maintained even when the heat exchanger has a heat capacity ratio of 0.7 to 1.2.

An amount of the BOG reliquefied is maintained at 50% or more of an HYSYS calculation value.

The high-pressure compressed BOG is in a super-critical state.

The high-pressure compressed BOG has a pressure of 100 bara to 400 bara.

The high-pressure compressed BOG has a pressure of 150 bara to 400 bara.

The high-pressure compressed BOG has a pressure of 150 bara to 300 bara.

According to embodiments, reliquefaction performance can be stably maintained regardless of change in flow rate of BOG to be re-liquefied.

According to embodiments, a fluid supplied to or discharged from a heat exchanger can be diffused, thereby preventing a flow of refrigerant from being concentrated on one diffusion block.

According to embodiments, a refrigerant can be evenly diffused inside one diffusion block, as well as evenly distributed to plural diffusion blocks, and a perforated panel can remain separated from a core. Particularly, it is possible to prevent the perforated panel from contacting the core and blocking a flow path of a fluid into the core.

According to embodiments, a perforated panel is coupled to a heat exchanger such that thermal expansion and contraction of the perforated panel can be relieved. Thus, the perforated plate can be prevented from being bent or broken despite suffering from shrinkage due to contact with BOG at ultra-low temperature and a joint between the perforated plate and the heat exchanger can also be prevented from being broken.

According to embodiments, the heat exchanger includes a channel capable of resisting a flow of fluid, thereby suppressing or preventing a flow of a refrigerant from being concentrated on one diffusion block without using a separate member for fluid diffusion.

BRIEF DESCRIPTION OF DRAWINGS

FIG. 1 shows a basic model of a BOG reliquefaction system according to one embodiment of the present invention.

FIGS. 2*a* to 2*i* show graphs depicting heat flux-dependent change in temperature of each of a hot fluid and a cold fluid, as measured when the pressure of BOG to be re-liquefied is 39 bara, and 50 bara to 120 bara (increased at intervals of 10 bara) in the BOG reliquefaction system according to the embodiment of the present invention.

FIGS. 3*a* to 3*i* show graphs depicting heat flux-dependent change in temperature of each of a hot fluid and a cold fluid, as measured when the pressure of BOG to be re-liquefied is 130 bara to 200 bara (increased at intervals of 10 bara) and 300 bara in the BOG reliquefaction system according to the embodiment of the present invention.

FIG. 4 is a schematic diagram of the BOG reliquefaction system according to the embodiment of the present invention when the pressure of BOG to be re-liquefied is 39 bara.

FIG. 5 is a schematic diagram of the BOG reliquefaction system according to the embodiment of the present invention when the pressure of BOG to be re-liquefied is 150 bara.

FIG. 6 is a schematic diagram of the BOG reliquefaction system according to the embodiment of the present invention when the pressure of BOG to be re-liquefied is 300 bara.

FIGS. 7 and 8 are graphs obtained by plotting "reliquefaction amount" shown in Table 1 in the pressure range of 39 bara to 300 bara.

FIG. 9 is a schematic view of a typical PCHE.

FIG. 10 is a schematic view of a heat exchanger according to a first embodiment of the present invention.

FIG. 11 is a schematic view of a first partition or a second partition included in a heat exchanger according to a second embodiment of the present invention.

FIG. 12 is a schematic view of the first partition and a first perforated panel included in the heat exchanger according to the second embodiment of the present invention.

FIG. 13 is a schematic view of a second partition and a second perforated panel included in the heat exchanger according to the second embodiment of the present invention.

FIG. 14 is a schematic view of a third partition or a fourth partition included in the heat exchanger according to the second embodiment of the present invention.

FIG. 15 is a schematic view of the third partition and a third perforated panel included in the heat exchanger according to the second embodiment of the present invention.

FIG. 16 is a schematic view of a fourth partition and a fourth perforated panel included in the heat exchanger according to the second embodiment of the present invention.

FIG. 17 shows (a) a schematic view of a flow of refrigerant in a typical heat exchanger, (b) a schematic view of a flow of refrigerant in the heat exchanger according to the first embodiment of the present invention, and (c) a schematic view of a flow of refrigerant in the heat exchanger according to the second embodiment of the present invention.

FIG. 18 shows (a) a schematic view showing the positions of temperature sensors installed to measure the internal temperature of each of the typical heat exchanger and the heat exchanger according to the present invention, and (b) graphs depicting the temperature distribution inside the heat exchangers measured by the temperature sensors at the positions shown in (a).

FIG. 19 is a schematic view of a portion of a heat exchanger according to a third embodiment of the present invention.

FIG. 20 is an enlarged view of portion A of FIG. 19.

FIG. 21 is a schematic view of a portion of a heat exchanger according to a fourth embodiment of the present invention.

FIG. 22 is an enlarged view of portion B of FIG. 21.

FIG. 23 shows (a) a schematic view of the entirety of a heat exchanger, (b) a schematic view of a diffusion block, and (c) a schematic view of a channel plate.

FIG. 24 shows (a) a schematic view of the cold fluid channel plate of (c) of FIG. 23, as viewed in direction "C", (b) a schematic view of a channel of a cold fluid channel plate of a typical heat exchanger, (c) is a schematic view of a channel of a cold fluid channel plate of a heat exchanger according to a fifth embodiment of the present invention, and (d) a schematic view of a channel of a cold fluid channel plate of a heat exchanger according to a sixth embodiment of the present invention.

DETAILED DESCRIPTION

Hereinafter, embodiments of the present invention will be described with reference to the accompanying drawings. The present invention may be applied to various ships such as a ship equipped with an engine fueled by natural gas and a ship including a liquefied gas storage tank. It should be understood that the following embodiments can be modified in various ways and do not limit the scope of the present invention.

A BOG treatment system according to the present invention described below may be applied to all types of ships and marine structures provided with a storage tank storing low-temperature liquid cargo or liquefied gas, including ships such as LNG carriers, liquefied ethane gas carriers, and LNG RVs and marine structures such as LNG FPSOs and LNG FSRUs. In the following embodiments, liquefied natural gas, which is a representative low-temperature liquid cargo, will be used by way of example, and the term "LNG ship(vessel)" may include LNG carriers, LNG RVs, LNG FPSOs, and LNG FSRUs, without being limited thereto.

In addition, a fluid in each line according to the present invention may be in any one of a liquid state, a gas-liquid mixed state, a gas state, and a supercritical fluid state, depending upon operating conditions of the system.

FIG. 1 shows a basic model of a BOG reliquefaction system according to one embodiment of the present invention.

Referring to FIG. 1, in the BOG reliquefaction system according to the present invention, BOG (①) discharged from a storage tank is sent to a heat exchanger to be used as a refrigerant and then compressed by a compressor. Then, the compressed BOG (②) is supplied as fuel to an engine and surplus BOG (②) exceeding fuel requirement of the engine is sent to the heat exchanger to be cooled through heat exchange with the BOG (①) discharged from the storage tank as the refrigerant.

The BOG having been compressed by the compressor and cooled by the heat exchanger is separated into a liquid component and a gaseous component by a gas/liquid separator after passing through a pressure reducing means (for example, an expansion valve, an expander, etc.). The liquid component separated by the gas/liquid separator is returned to the storage tank and the gaseous component separated by the gas/liquid separator is combined with the BOG (①) discharged from the storage tank and then supplied to the heat exchanger to be used as the refrigerant.

In the BOG reliquefaction system according to the present invention, reliquefaction of BOG is performed using BOG discharged from the storage tank as refrigerant without any separate cycle for reliquefaction of BOG. It should be understood that the present invention is not limited thereto and a separate refrigeration cycle may be established to ensure reliquefaction of all BOG, as needed. Such a separate cycle can ensure reliquefaction of almost all BOG despite requiring separate equipment or an additional power source.

Reliquefaction performance of a BOG reliquefaction system using BOG as refrigerant as set forth above varies greatly depending on the pressure of BOG to be liquefied (hereinafter, "reliquefaction target BOG"). An experiment (hereinafter, "Experiment 1") was conducted to determine change in reliquefaction performance with varying pressure of reliquefaction target BOG. Results are as follows:

Experiment 1

Experiment 1 was conducted under the following conditions:

1. Target vessel: An LNG carrier including a high-pressure gas injection engine as a propulsion engine and a low-pressure engine as a power generation engine.
2. Process simulator: Aspen HYSYS V8.0
3. Equation for calculating property values: Peng-Robinson equation
4. Amount of BOG: 3800 kg/h, in consideration of the fact that about 3500 kg/h to about 4000 kg/h of BOG is generated in a 170,000 cubic meter (CBM) LNG carrier.
5. Component of BOG: 10% nitrogen ($N_2$) and 90% methane ($CH_4$), common to BOG discharged from the storage tank and BOG compressed by the compressor.
6. Pressure and temperature of BOG discharged from storage tank: Pressure: 1.06 bara, temperature: −120° C.
7. Fuel consumption of engine: The total BOG consumption by the propulsion engine and the power generation engine was assumed to be 2,660 kg/h, accounting for 70% of the total amount of BOG generated in the storage tank (3,800 kg/h), although such engines are operated under a low load in view of economic efficiency in actual operation of an LNG vessel.
8. Capacity of compressor: Capacity of the compressor was assumed to cover 120% (3,800 kg/h×120%=4,650 kg/h) of the amount of BOG generated in the storage tank in terms of the intake flow rate of the compressor, considering that the compressor has a capacity to cover up to 150% of the total amount of BOG generated in the storage tank.
9. Performance of heat exchanger: Logarithmic mean temperature difference (LMTD); 13° C. or higher, minimum approach: 3° C. or higher In design of a heat exchanger, for given temperature and heat flux values of a cold fluid and a hot fluid introduced into the heat exchanger, the logarithmic mean temperature difference (LMTD) is minimized to the extent that the temperature of a fluid used as a refrigerant is not higher than the temperature of a fluid to be cooled (that is, to the extent that graphs depicting the heat flux-dependent temperature of the cold fluid and the hot fluid do not cross each other).

For a countercurrent flow heat exchanger in which a hot fluid and a cold fluid are introduced and discharged in opposite directions, respectively, the LMTD is a value expressed by $(d2-d1)/\ln(d2/d1)$, wherein $di=th2-tc1$ and $d2=th1-tc2$ (tc1: temperature of the cold fluid before the heat exchanger, tc2: temperature of the cold fluid having passed through the heat exchanger, th1: temperature of the hot fluid before the heat exchanger, th2: temperature of the hot fluid having passed through the heat exchanger). Here, a lower value of the LMTD indicates higher efficiency of the heat exchanger.

The LMTD is represented by the distance between graphs depicting the heat flux-dependent temperature of the cold fluid used as a refrigerant and the hot fluid cooled through heat exchange with the refrigerant. A shorter distance between the graphs indicates a lower value of the LMTD, which, in turn, indicates higher efficiency of the heat exchanger.

Under the above experimental conditions 1 to 9, thermodynamic calculations were performed to quantitatively demonstrate the effect of high-pressure compression of reliquefaction target BOG on reliquefaction performance. In order to verify BOG pressure-dependent reliquefaction performance and cooling curve characteristics of the heat exchanger, the reliquefaction amount and cooling curve of the heat exchanger were thermodynamically calculated when the pressure of reliquefaction target BOG was 39 bara, 50 bara to 200 bara (at intervals of 10 bara), 250 bara, and 300 bara.

FIGS. 2*a* to 2*i* show graphs depicting heat flux-dependent change in temperature of each of a hot fluid and a cold fluid, as measured when the pressure of reliquefaction target BOG is 39 bara, and 50 bara to 120 bara (increased at intervals of 10 bara) in the BOG reliquefaction system according to the embodiment of the present invention, and FIGS. 3*a* to 3*i* show graphs depicting heat flux-dependent change in temperature of each of a hot fluid and a cold fluid, as measured when the pressure of reliquefaction target BOG is 130 bara to 200 bara (increased at intervals of 10 bara) and 300 bara in the BOG reliquefaction system according to the embodiment of the present invention.

FIG. 4 is a schematic diagram of the BOG reliquefaction system according to the embodiment of the present invention when the pressure of reliquefaction target BOG is 39 bara, FIG. 5 is a schematic diagram of the BOG reliquefaction system according to the embodiment of the present invention when the pressure of reliquefaction target BOG is 150 bara, and FIG. 6 is a schematic diagram of the BOG reliquefaction system according to the embodiment of the present invention when the pressure of reliquefaction target BOG is 300 bara.

Table 1 shows theoretical expected values of reliquefaction performance of the BOG reliquefaction system according to the embodiment of the present invention depending upon the pressure of reliquefaction target BOG.

TABLE 1

| Pressure of reliquefaction target BOG (bara) | Cooling temperature before expansion (deg C.) | Reliquefaction amount (kg/h) | Relative proportion of reliquefaction amount (%) |
|---|---|---|---|
| 39 | −97.7 | 563.8 | 100.0 |
| 50 | −96.1 | 712.8 | 126.4 |
| 60 | −99.6 | 821.6 | 145.7 |
| 70 | −103.8 | 909.3 | 161.3 |
| 80 | −107.8 | 979.9 | 173.8 |
| 90 | −111.5 | 1036.4 | 183.9 |
| 100 | −114.6 | 1080.5 | 191.7 |
| 110 | −117.0 | 1113.8 | 197.6 |
| 120 | −119.0 | 1137.9 | 201.9 |
| 130 | −120.4 | 1154.7 | 204.8 |
| 140 | −121.4 | 1165.9 | 206.8 |
| 150 | −122.1 | 1173.8 | 208.1 |
| 160 | −122.4 | 1174.6 | 208.4 |
| 170 | −122.4 | 1172.7 | 208.0 |
| 180 | −122.4 | 1170.7 | 207.7 |
| 190 | −122.4 | 1168.6 | 207.3 |
| 200 | −122.4 | 1166.3 | 206.9 |
| 250 | −122.5 | 1153.4 | 204.6 |
| 300 | −122.6 | 1138.2 | 201.9 |

FIGS. 7 and 8 are graphs obtained by plotting "reliquefaction amount" of Table 1 in the pressure range of 39 bara to 300 bara.

Referring to FIGS. 2(2*a* to 2*i*) to 8 and Table 1, it can be seen that even when reliquefaction target BOG is in a supercritical fluid state, a horizontal section, similar to a latent heat section that appears when the pressure of reliquefaction target BOG is 39 bara, is still present on the cooling curves of reliquefaction target BOG calculated when the pressure of the BOG is in the range of 50 bara to 100 bara, despite being gradually reduced. In addition, the reliquefaction amount has the maximum value when the pressure of the BOG is 160 bara (cooling temperature before expansion: −122.4° C., reliquefaction amount: 1174.6 kg/h, relative proportion of reliquefaction amount: 208.4%).

The greatest difference between reliquefaction target BOG at low pressure and reliquefaction target BOG at high pressure is "cooling temperature before expansion". As shown in FIG. 8, due to the difference between pressure-dependent cooling curves, there is a limit to lowering the cooling temperature before expansion of reliquefaction target BOG at low pressure, whereas reliquefaction target BOG at high pressure can be cooled to a temperature close to the temperature of BOG discharged from the storage tank.

This is because, due to properties of methane ($CH_4$), which is a main component of BOG, a latent heat section is present on the graph of heat flux-dependent change in temperature when the pressure of BOG is below a critical pressure (about 47 bara for pure methane) and a section similar to the latent heat section is still present but reduced when the pressure of BOG is higher than or equal to the critical pressure. Thus, it is desirable that reliquefaction of BOG be performed at a pressure higher than or equal to 47 bara, i.e., the critical pressure, in view of increase in reliquefaction amount.

Generally, an ME-GI engine is supplied with a fuel gas at a pressure of 150 bara to 400 bara (particularly 300 bara). As shown in FIG. 7 and Table 1, the reliquefaction amount has the maximum value when reliquefaction target BOG has a pressure of about 150 bara to about 170 bara, and there is little change in reliquefaction amount when the pressure of reliquefaction target BOG is in the range of 150 bara to 300 bara. Thus, such an ME-GI engine advantageously allows easy control over reliquefaction or supply of BOG.

In Table 1, "reliquefaction amount" denotes an amount of re-liquefied LNG having passed through the compressor 10, the heat exchanger 20, the pressure reducer 30, and the gas/liquid separator 40 as shown in FIGS. 4 to 6, and "relative proportion of reliquefaction amount" denotes a relative proportion (in %) of the reliquefaction amount at each pressure value of reliquefaction target BOG to the reliquefaction amount when the pressure of reliquefaction target BOG is 39 bara.

In addition, the reliquefaction performance may be represented by "reliquefaction rate", which refers to a value obtained by dividing the amount of re-liquefied LNG by the total amount of the reliquefaction target BOG. In other words, "reliquefaction amount" indicates the absolute amount of re-liquefied LNG and "reliquefaction rate" indicates a proportion of the re-liquefied LNG to total reliquefaction target BOG.

For example, when an LNG vessel is operated at low speed and BOG consumption of a propulsion engine is thus reduced, the amount of reliquefaction target BOG increases causing increase in "reliquefaction amount". However, under the conditions of Experiment 1, "reliquefaction rate" can be reduced since the sum of the BOG discharged from the storage tank, which is a fluid used as a refrigerant, and the gaseous component separated by the gas/liquid separator is almost constant due to capacity limitations of the compressor.

In Experiment 1, the flow rate of the refrigerant into the compressor is 4560 kg/h, which is 120% of the flow rate (3800 kg/h) of BOG from the storage tank, and the flow rate of reliquefaction target BOG is 1,900 kg/h, which is obtained by subtracting 2660 kg/h, which is a gas consumption of engines (ME-GI engine: 2,042 kg/h+DFDE engine: 618 kg/h) from the flow rate of the refrigerant into the compressor.

In addition, no great change in reliquefaction amount was observed when the pressure of reliquefaction target BOG was increased from 300 bara to 400 bara, and a difference between reliquefaction amounts when the pressure of reliquefaction target BOG is 150 bara and when the pressure of reliquefaction target BOG is 400 bara was less than 4%.

In each of the graphs depicting FIGS. 2(FIGS. 2*a* to 2*i*) and 3(FIGS. 3*a* to 3*i*), the hot fluid in red (above) represents reliquefaction target BOG and the cold fluid in blue (below) represents BOG discharged from the storage tank, i.e., the refrigerant.

In each of the graphs depicting FIGS. 2(FIGS. 2*a* to 2*i*) and 3(FIGS. 3*a* to 3*i*), the linear section in which there is no temperature change with varying heat flux is a latent heat section. Since the latent heat section does not appear when methane is in a supercritical fluid state, there is a great difference in reliquefaction amount depending upon whether BOG is in a supercritical fluid state or not. In other words, when reliquefaction target BOG is a supercritical fluid, the latent heat section does not appear upon heat exchange, such that the reliquefaction amount and the reliquefaction rate both have high values.

In conclusion, high reliquefaction performance can be obtained when reliquefaction target BOG is in a supercritical state, particularly when the pressure of reliquefaction target BOG is in the range of 100 bara to 400 bara, preferably 150 bara to 400 bara, more preferably 150 bara to 300 bara.

Considering that an ME-GI engine is requires a fuel gas in the pressure range of 150 bara and 400 bara, when BOG compressed to a pressure level that meets pressure requirements of the ME-GI engine is used as reliquefaction target BOG, high reliquefaction performance can be obtained. Therefore, a system fueling an ME-GI engine is advantageously associated with a BOG reliquefaction system in which BOG is used as a refrigerant.

In Experiment 1, reliquefaction performance depending upon the pressure of reliquefaction target BOG was evaluated using a simulation program. In order to investigate whether the same is true for an actual reliquefaction apparatus using a heat exchanger, an experiment using a printed circuit heat exchanger (PCHE) (hereinafter, "Experiment 2") was conducted.

Experiment 2

Under actual operating conditions of an LNG vessel, emission of BOG is constant, but BOG consumption of an engine is changed, resulting in change in amount of surplus BOG, i.e., a reliquefaction target. In Experiment 2, reliquefaction performance of an actual reliquefaction apparatus was evaluated while varying the amount of reliquefaction target BOG. For experimental convenience, nitrogen was initially used in place of methane, which is explosive; the temperature of nitrogen used as a refrigerant was adjusted to be equal to the temperature of BOG discharged from the storage tank; and the other conditions were also adjusted to be identical to conditions 1 to 9 of Experiment 1.

Considering that fuel consumption of an ME-GI engine varies depending on operating conditions, the ME-GI engine is assumed to be used in an actual LNG carrier. Under the conditions in Experiment 1, assuming that the size of the ME-GI engine is 25 MW (two units of 12.5 MW), the LNG carrier may sail at about 19.5 knots when operated at full speed (fuel consumption of the engine: about 3,800 kg/h) and may sail at 17 knots when operated at economical speed (fuel consumption of the engine: about 2,660 kg/h). Considering actual operating conditions, the LNG carrier is supposed to be in operation at a full speed of about 19.5 knots, in operation at an economical speed of 17 knots, or at anchor (fuel consumption of ME-GI engine: 0, fuel consumption of DFDG engine: 618 kg/h). In Experiment 2, reliquefaction performance was evaluated assuming that the LNG carrier would be operated under these conditions.

In a test using nitrogen as refrigerant and reliquefaction target BOG, reliquefaction performance was almost the same level as theoretical expected values in Experiment 1 regardless of the amount of reliquefaction target BOG. In other words, although BOG consumption of a propulsion engine and thus the amount of reliquefaction target BOG varied depending upon the speed of the LNG carrier, reliquefaction performance remained stable regardless of the amount of reliquefaction target BOG when nitrogen was used as a refrigerant and reliquefaction target BOG.

In a test using methane (i.e., BOG generated in an actual storage tank) as refrigerant and reliquefaction target BOG instead of nitrogen in the actual BOG reliquefaction system, reliquefaction performance was almost the same level as the theoretical expected values in Experiment 1 when the LNG carrier was at anchor or in operation at approximately full speed (during operation at full speed, most of the BOG generated in the LNG storage tank can be used as fuel). However, when the LNG carrier was in operation at economical speed (fuel consumption: 70% of the fuel consumption in full-speed operation) or in operation at a speed below the economical speed, reliquefaction performance was below 70% of the theoretical expected values and, particularly was much lower than that level in a specific speed range. In other words, in the test using methane (i.e., BOG generated in an actual storage tank) as refrigerant and reliquefaction target BOG, reliquefaction performance fell short of the theoretical expected values when the amount of reliquefaction target BOG was in a specific range.

Specifically, reliquefaction performance fell short of the theoretical expected values under the following conditions:

1. When the LNG carrier using a 25 MW ME-GI engine was operated at a speed of 10 to 17 knots.
2. When the amount of BOG generated in the storage tank was 3,800 kg/h and the amount of BOG used as fuel in engines (ME-GI engine for propulsion+DFDG engine for power generation) was in the range of 1,100 kg/h to 2,660 kg/h.
3. When the amount of BOG generated in the storage tank was 3,800 kg/h and the amount of reliquefaction target BOG was in the range of 1,900 kg/h to 3,300 kg/h.
4. When an amount ratio of reliquefaction target BOG to BOG used as a refrigerant (including the gaseous component separated by the gas/liquid separator) was in the range of 0.42 to 0.72.

As described above, there was a great difference between an actual value and a theoretical expected value of reliquefaction amount depending on the operating conditions of the LNG carrier or the amount of reliquefaction target BOG. Therefore, it is necessary to solve this problem. If the amount of BOG having failed to be re-liquefied is increased due to poor reliquefaction performance, the BOG needs to be discharged to the outside or to be combusted, which causes waste of energy or a need for a separate reliquefaction cycle. Such a difference between nitrogen and BOG in terms of a degree of similarity of an actual value of reliquefaction amount to a theoretical expected value is thought to be due to difference in properties between nitrogen and BOG.

From the above results, it can be seen that there is a need for a process which can stably maintain reliquefaction performance, regardless of change in operating conditions of an LNG carrier, i.e., change in amount of reliquefaction target BOG.

In accordance with one aspect of the present invention, a BOG reliquefaction method for an LNG vessel having a high-pressure gas injection engine includes: compressing BOG discharged from the storage tank to high pressure and forcing all or some fraction of the high-pressure compressed BOG to exchange heat with BOG discharged from the storage tank; and reducing the pressure of the heat-exchanged high-pressure compressed BOG, wherein the method further includes stably maintaining reliquefaction performance regardless of change in operating conditions of the LNG vessel or change in amount of reliquefaction target BOG.

If an engine provided to the LNG vessel is an engine fueled by BOG at low pressure, such as an X-DF engine, rather than a high-pressure gas injection engine, the BOG reliquefaction method according to the present invention is advantageously employed to further compress and re-liquefy surplus BOG among BOG having been compressed to be supplied to the low-pressure engine.

The BOG reliquefaction method is advantageously used when the LNG vessel is operated at a speed of 10 to 17 knots, when a flow rate of BOG used as fuel in the engines (propulsion engine+power generation engine) is in the range of 1,100 kg/h to 2,660 kg/h, when a flow rate of reliquefaction target BOG is in the range of 1,900 kg/h to 3,300 kg/h, or when an amount ratio of reliquefaction target BOG to BOG used as a refrigerant (including the gaseous component separated by the gas/liquid separator) is in the range of 0.42 to 0.72.

In the BOG reliquefaction method, stably maintaining reliquefaction performance includes stably maintaining reliquefaction performance when the heat exchanger has a heat capacity ratio of 0.7 to 1.2.

When the heat capacity ratio is CR, a flow rate of a hot fluid (herein, reliquefaction target BOG) is m1, a specific heat of the hot fluid is c1, a flow rate of a cold fluid (herein, BOG used as the refrigerant) is m2, and a specific heat of the cold fluid is c2, the following equation is satisfied:

$$CR=(m1\times c1)/(m2\times c2)$$

In Experiment 2, it was confirmed that reliquefaction performance fell short of theoretical expected values when the amount of BOG used as the refrigerant (including the gaseous component obtained through the gas/liquid separator) was kept constant and the amount of reliquefaction target BOG was changed, that is, when m2 is kept constant and m1 is changed in the above equation. In addition, it was also confirmed that reliquefaction performance fell short of theoretical expected values when the amount of BOG used as the refrigerant (including the gaseous component obtained through the gas/liquid separator) was changed, that is, when m2 is changed in the above equation.

Thus, in the BOG reliquefaction method according to the present invention, stably maintaining reliquefaction performance further includes stably maintaining reliquefaction performance when the heat capacity ratio of the heat exchanger is in the range of 0.7 to 1.2 due to change in at least one of the amount of BOG used as the refrigerant (including the gaseous component obtained through the gas/liquid separator) and the amount of reliquefaction target BOG.

In the BOG reliquefaction method, stably maintaining reliquefaction performance further includes allowing the reliquefaction amount to be maintained above 50% of a theoretical expected value under the conditions of Experiment 1. Preferably, the reliquefaction amount is maintained above 60% of the theoretical expected value, more preferably above 70% of the theoretical expected value. If the reliquefaction amount is less than or equal to 50% of the theoretical expected value, there is a problem in that surplus BOG needs to be combusted in a gas combustion unit (GCU) during operation of the LNG vessel under specific operating conditions of the LNG vessel.

From the above results, it can be seen that it is necessary to stably maintain reliquefaction performance regardless of change in operating conditions of the LNG vessel, that is, regardless of change in flow rate of reliquefaction target BOG.

Further, it was found that a heat exchanger including at least two blocks combined together contributes to the significant difference between an actual value and a theoretical expected value of reliquefaction performance.

Examples of a typical heat exchanger used in a BOG reliquefaction system for an LNG vessel include PCHEs, commercially available from KOBELCO Construction Machinery Co., Ltd., Alfa Laval Co., Ltd., Heatric Corporation, and the like. Such a PCHE generally includes at least two diffusion blocks combined together since a single diffusion block has limited capacity.

If the capacity of boil-off gas when it needs to be used by at least two diffusion blocks combined together is 'A or more and B or less(A~B)', A can be one of 1500 kg/h, 2000 kg/h, 2500 kg/h, 3000 kg/h and 3500 kg/h and B can be one of 7000 kg/h, 6000 kg/h, and 5000 kg/h. For example, the capacity of boil-off gas when it needs to be used by at least two diffusion blocks combined together can be 2500 kg/h or more and 5000 kg/h or less(2500 kg/h~5000 kg/h).

FIG. 9 is a schematic view of a typical PCHE.

Referring to FIG. 9, a typical PCHE includes a hot fluid inlet pipe 110, a hot fluid inlet header, a core 190, a hot fluid outlet header 130, a hot fluid outlet pipe 140, a cold fluid inlet pipe 150, a cold fluid inlet header 160, a cold fluid outlet header 170, and a cold fluid outlet pipe 180.

A hot fluid is supplied into the heat exchanger through the hot fluid inlet pipe 110 and then diffused by the hot fluid inlet header 120 to be sent to the core 190. Then, the hot fluid is cooled in the core 190 through heat exchange with a cold fluid and then collected in the hot fluid outlet header 130 to be discharged to the outside of the heat exchanger through the hot fluid outlet pipe 140.

The cold fluid is supplied into the heat exchanger through the cold fluid inlet pipe 150 and is then diffused by the cold fluid inlet header 160 to be sent to the core 190. Then, the cold fluid is used as a refrigerant in the core 190 to cool the hot fluid through heat exchange and then collected in the cold fluid outlet header 170 to be discharged to the outside of the heat exchanger through the cold fluid outlet pipe 180.

In the present invention, a cold fluid used as the refrigerant in a heat exchanger is BOG discharged from a storage tank (including a gaseous component separated by a gas/liquid separator, and a hot fluid cooled in the heat exchanger is compressed reliquefaction target BOG.

In the typical PCHE, the core 190 may include a plurality of diffusion blocks (In FIG. 9, the core is shown as including three diffusion blocks. Although a core including three diffusion blocks will be used as an example hereinafter, it should be understood that the present invention is not limited thereto). When the core of the heat exchanger includes two or more diffusion blocks, there is a space between the diffusion blocks, such that air in the space acts as a heat insulating layer causing reduction in thermal conductivity between the diffusion blocks.

Referring to the graph of FIG. 18(*b*), the heat insulating layers between the diffusion blocks contribute to nonuniform of temperature distribution among the diffusion blocks.

In addition, when BOG is used as a refrigerant, a flow of the refrigerant is likely to be concentrated on any one of the plural diffusion blocks, which has first received the refrigerant, causing the temperature of that diffusion block to become lower than those of the other diffusion blocks.

When concentration of the refrigerant in one diffusion block having first received the refrigerant is combined with reduction in thermal conductivity between the diffusion blocks, there can be a great difference in temperature between the blocks, causing deterioration in reliquefaction performance. That is, although good thermal conductivity between the blocks can secure an insignificant difference in temperature between the blocks despite concentration of the refrigerant in one block, the difference in temperature between the blocks can increase when air in a space between the block acts as a thermal insulating layer.

FIG. 10 is a schematic view of a heat exchanger according to a first embodiment of the present invention.

Referring to FIG. 10, a heat exchanger according to this embodiment further includes at least one of a first perforated panel 210 disposed between the hot fluid inlet header 120 and the core 190, a second perforated panel 220 disposed between the hot fluid outlet header 130 and the core 190, a third perforated panel 230 disposed between the cold fluid inlet header 160 and the core 190, and a fourth perforated panel 240 disposed between the cold fluid outlet header 170 and the core 190, in addition to the components of the typical heat exchanger as shown in FIG. 9.

The heat exchanger according to this embodiment is characterized by including a means for diffusing a fluid supplied to or discharged from the heat exchanger, specifically a means for resisting a flow of a fluid to diffuse the fluid. Although the perforated panels 210, 220, 230, 240 are shown as the means for diffusing a fluid or the means for resisting a flow of a fluid herein, it should be understood that the means for diffusing a fluid is not limited to the perforated panels.

In this embodiment, each of the perforated panels 210, 220, 230, 240 is a thin plate member having a plurality of holes. Preferably, the first perforated panel 210 has the same cross-sectional size and shape as the hot fluid inlet header 120, the second perforated panel 220 has the same cross-sectional size and shape as the hot fluid outlet header 130, the third perforated panel 210 has the same cross-sectional size and shape as the cold fluid inlet header 160, and the fourth perforated panel 210 has the same cross-sectional size and shape as the cold fluid outlet header 120.

In this embodiment, the plurality of holes formed through each of the perforated panels 210, 220, 230, 240 may have the same cross-sectional area. Alternatively, the plurality of holes may have cross-sectional areas that increase with increasing distance from the pipe 110, 140, 150, or 180 through which a fluid is introduced or discharged.

In addition, the plurality of holes formed through each of the perforated panels 210, 220, 230, 240 may have a uniform density. Alternatively, the plurality of holes may have a density that increases with increasing distance from the pipe 110, 140, 150, or 180 through which a fluid is introduced or discharged. A lower density of the holes indicates a smaller number of holes per unit area.

Preferably, the perforated panels 210, 220, 230, 240 are separated a predetermined distance from the core 190 such that a fluid having passed through the first perforated panel 210 and the third perforated panel 230 toward the core 190 can be effectively diffused and a fluid having been discharged from the core 190 toward the second perforated panel 220 and the fourth perforated panel 240 can be effectively diffused. For example, each of the perforated panels 210, 220, 230, 240 may be separated a distance of 20 mm to 50 mm from the core 190.

The heat exchanger according to this embodiment allows a fluid to be diffused by at least one of the first to fourth perforated panels 210, 220, 230, 240, thereby reducing concentration of a flow of the refrigerant in one of the diffusion blocks.

A heat exchanger according to a second embodiment of the present invention further includes a first partition 230 disposed between the first perforated panel 210 and the core 190, a second partition 320 disposed between the second perforated panel 220 and the core 190, a third partition 330 disposed between the third perforated panel 230 and the core 190, and a fourth partition 340 between the fourth perforated panel 240 and the core 190, in addition to the components of the heat exchanger according to the first embodiment.

FIG. 11 is a schematic view of the first partition or the second partition included in the heat exchanger according to the second embodiment of the present invention, FIG. 12 is a schematic view of the first partition and the first perforated panel included in the heat exchanger according to the second embodiment of the present invention, and FIG. 13 is a schematic view of the second partition and the second perforated panel included in the heat exchanger according to the second embodiment of the present invention.

In this embodiment, each of the first to fourth partitions 310, 320, 330, 340 serves to prevent a fluid diffused by each of the first to fourth perforated panels 210, 220, 230, 240 from being combined again.

Referring to FIGS. 11 and 12, the first partition 310 according to this embodiment may have a predetermined height and may be configured to surround the first perforated panel 210 and to divide the surrounded inner space into plural sections. In FIGS. 11(*a*) and 12(*a*), the inner space of the first perforated panel 210 surrounded by the first partition having the predetermined height is shown as divided into 4 sections, and, in FIGS. 11(*b*) and 12(*b*), the inner space is shown as divided into 8 sections.

Unlike the first partition shown in FIGS. 11(*a*) and 12(*a*), which has a grid structure composed solely of parallel bars, the first partition 310 shown in FIGS. 11(*b*) and 12(*b*) has a grid structure composed of crisscrossed bars. In other words, when the parallel bars of the first partition 310 shown in FIGS. 11(*a*) and 12(*a*) are referred to as vertical members 1, the first partition 310 shown in in FIGS. 11(*b*) and 12(*b*) further includes plural horizontal members 2 each horizontally dividing a space between a pair of adjacent vertical members 1, in addition to the vertical members 1 vertically dividing the inner space surrounded by the first partition having the predetermined height.

When the inner space of the first perforated panel 210 is divided by a grid of crisscrossed bars, as shown in FIGS. 11(*b*) and 12(*b*), a fluid can be better diffused and, particularly, the refrigerant can be prevented from being collected again inside one diffusion block, as well as prevented from being concentrated on one of the plural diffusion blocks.

In addition, dividing the inner space of the first perforated panel 210 by a grid of crisscrossed bars advantageously allows the first perforated panel 210 to remain spaced apart from the core 190. Particularly, it is possible to prevent the first perforated panel 210 from being bent and contacting the core 190 due to the pressure of a fluid passing through the first perforated panel 210. If the first perforated panel 210 contacts the core 190, a fluid is not likely to be properly supplied to the core at the contact portion, causing reduction in heat exchange efficiency.

Referring to FIGS. 10 and 12, a hot fluid introduced through the hot fluid inlet pipe 110 sequentially passes through the hot fluid inlet header 120, the first perforated panel 210 and the first partition 310 before flowing into the core 190.

Referring to FIGS. 11 and 13, the second partition 320 according to this embodiment may have a predetermined height and may be configured to surround the second perforated panel 220 and to divide the surrounded inner space into plural sections. In FIGS. 11(*a*) and 13(*a*), the inner space of the second perforated panel 220 surrounded by the second partition having the predetermined height is shown as divided into 4 sections, and, in FIGS. 11(*b*) and 13(*b*), the inner space is shown as divided into 8 sections.

Unlike the second partition shown in FIGS. 11(*a*) and 13(*a*), which has a grid structure composed solely of parallel bars, the second partition 320 shown in FIGS. 11(*b*) and 13(*b*) has a grid structure composed of crisscrossed bars. In other words, when the parallel bars of the second partition 320 shown in FIGS. 11(*a*) and 13(*a*) are referred to as vertical members 1, the second partition 320 shown in in FIGS. 11(*b*) and 13(*b*) further includes plural horizontal members 2 each horizontally dividing a space between a pair of adjacent vertical members 1, in addition to the vertical members 1 vertically dividing the inner space surrounded by the second partition having the predetermined height.

When the inner space of the second perforated panel 220 is divided by a grid of crisscrossed bars, as shown in FIGS. 11(*b*) and 13(*b*), a fluid can be better diffused and, particularly, the refrigerant can be prevented from being collected again inside one diffusion block, as well as prevented from being concentrated on one of the plural diffusion blocks.

In addition, dividing the inner space of the second perforated panel 220 by a grid of crisscrossed bars advantageously allows the second perforated panel 220 to remain spaced apart from the core 190. Particularly, it is possible to prevent the second perforated panel 220 from being bent and contacting the core 190 due to the pressure of a fluid passing through the second perforated panel 220. If the second perforated panel 220 contacts the core 190, a fluid is not likely to be properly supplied to the core at the contact portion, causing reduction in heat exchange efficiency.

Referring to FIGS. 10 and 13, a hot fluid discharged from the core 190 sequentially passes through the second partition 320, the second perforated panel 220, and the hot fluid outlet header 130 before being discharged through the hot fluid outlet pipe 140.

FIG. 14 is a schematic view of the third partition or the fourth partition included in the heat exchanger according to the second embodiment of the present invention, FIG. 15 is a schematic view of the third partition and the third perforated panel included in the heat exchanger according to the second embodiment of the present invention, and FIG. 16 is a schematic view of the fourth partition and the fourth perforated panel included in the heat exchanger according to the second embodiment of the present invention.

Referring to FIGS. 14 and 15, the third partition 330 according to this embodiment may have a predetermined height and may be configured to surround the third perforated panel 230 and to divide the surrounded inner space into plural sections. In FIGS. 14(*a*) and 15(*a*), the inner space of the third perforated panel 230 surrounded by the third partition having the predetermined height is shown as divided into 4 sections, and, in FIGS. 14(*b*) and 15(*b*), the inner space is shown as divided into 8 sections.

Unlike the first partition shown in FIGS. 14(*a*) and 15(*a*), which has a grid structure composed solely of parallel bars, the third partition 330 shown in FIGS. 14(*b*) and 15(*b*) has a grid structure composed of crisscrossed bars. In other words, when the parallel bars of the third partition 330 shown in FIGS. 14(*a*) and 15(*a*) are referred to as vertical members 1, the third partition 330 shown in FIGS. 14(*b*) and 15(*b*) further includes plural horizontal members 2 each horizontally dividing a space between a pair of adjacent vertical members 1, in addition to the vertical members 1 vertically dividing the inner space surrounded by the third partition having the predetermined height.

When the inner space of the third perforated panel 230 is divided by a grid of crisscrossed bars, as shown in FIGS. 14(*b*) and 15(*b*), a fluid can be better diffused and, particularly, the refrigerant can be prevented from being collected again inside one diffusion block, as well as prevented from being concentrated on one of the plural diffusion blocks.

In addition, dividing the inner space of the third perforated panel 230 by a grid of crisscrossed bars advantageously allows the third perforated panel 230 to remain spaced apart from the core 190. Particularly, it is possible to prevent the third perforated panel 230 from being bent and contacting the core 190 due to the pressure of a fluid passing through the third perforated panel 230. If the third perforated panel 230 contacts the core 190, a fluid is not likely to be properly supplied to the core at the contact portion, causing reduction in heat exchange efficiency.

Referring to FIGS. 10 and 15, a cold fluid introduced through the cold fluid inlet pipe 150 sequentially passes through the cold fluid inlet header 160, the third perforated panel 230 and the third partition 330 before flowing into the core 190.

Referring to FIGS. 14 and 16, the fourth partition 340 according to this embodiment may have a predetermined height and may be configured to surround the fourth perforated panel 240 and to divide the surrounded inner space into plural sections. In FIGS. 14(*a*) and 16(*a*), the inner space of the fourth perforated panel 240 surrounded by the fourth partition having the predetermined height is shown as divided into 4 sections, and, in FIGS. 14(*b*) and 16(*b*), the inner space is shown as divided into 8 sections.

Unlike the fourth partition shown in FIGS. 14(*a*) and 16(*a*), which has a grid structure composed solely of parallel bars, the fourth partition 340 shown in FIGS. 14(*b*) and 16(*b*) has a grid structure composed of crisscrossed bars. In other words, when the parallel bars of the fourth partition 340 shown in FIGS. 14(*a*) and 16(*a*) are referred to as vertical members 1, the fourth partition 340 shown in FIGS. 14(*b*) and 16(*b*) further includes plural horizontal members 2 each horizontally dividing a space between a pair of adjacent vertical members 1, in addition to the vertical members 1 vertically dividing the inner space surrounded by the fourth partition having the predetermined height.

When the inner space of the fourth perforated panel 240 is divided by a grid of crisscrossed bars, as shown in FIGS. 14(*b*) and 16(*b*), a fluid can be better diffused and, particularly, the refrigerant can be prevented from being collected again inside one diffusion block, as well as prevented from being concentrated on one of the plural diffusion blocks.

In addition, dividing the inner space of the fourth perforated panel 240 by a grid of crisscrossed bars advantageously allows the fourth perforated panel 240 to remain spaced apart from the core 190. Particularly, it is possible to prevent the fourth perforated panel 240 from being bent and contacting the core 190 due to the pressure of a fluid passing through the fourth perforated panel 240. If the fourth perforated panel 240 contacts the core 190, a fluid is not likely to be properly supplied to the core at the contact portion, causing reduction in heat exchange efficiency.

Referring to FIGS. 10 and 16, a cold fluid discharged from the core 190 sequentially passes through the fourth partition 340, the fourth perforated panel 240, and the cold fluid outlet header 170 before being discharged through the cold fluid outlet pipe 180.

FIG. 17(*a*) is a schematic view of a flow of refrigerant in a typical heat exchanger, FIG. 17(*b*) is a schematic view of a flow of refrigerant in the heat exchanger according to the first embodiment of the present invention, and FIG. 17(*c*) is a schematic view of a flow of refrigerant in the heat exchanger according to the second embodiment of the present invention.

Referring to FIG. 17(*a*), in the typical heat exchanger, supply of a cold fluid introduced into the cold fluid inlet pipe 150 is concentrated on a middle diffusion block near the cold fluid inlet pipe 150. In the typical heat exchanger including three diffusion blocks, about 70% of refrigerant is supplied to a middle diffusion block near the cold fluid inlet pipe 150 and about 15% of refrigerant is supplied to each of the other diffusion blocks. In other words, the amount of refrigerant supplied to the middle diffusion block is more than 4 times that of refrigerant supplied to each of the other diffusion blocks.

Referring to FIG. 17(*b*), in the heat exchanger according to the first embodiment of the present invention, a cold fluid introduced into the cold fluid inlet pipe 150 is diffused by the third perforated panel 230 and is relatively evenly distributed to plural diffusion blocks, as compared with that of the typical heat exchanger. However, supply of the cold fluid is still concentrated on a middle diffusion block near the cold fluid inlet pipe 150 to some degree.

Referring to FIG. 17(*c*), in the heat exchanger according to the second embodiment of the present invention, a cold fluid introduced into the cold fluid inlet pipe 150 is diffused by the third perforated panel 230 prior to passing through the third partition 330 and relatively evenly distributed to plural diffusion blocks, as compared with that of the heat exchanger according to the first embodiment as well as that of the typical heat exchanger.

The heat exchanger according to this embodiment is characterized in that the difference between the flow rates of fluid supplied to each of the plurality of blocks or discharged therefrom may be less than 4 times. That is, for the heat exchanger according to this embodiment, the largest flow rate of fluid supplied to each of the plurality of blocks may be less than 4 times the smallest flow rate of fluid supplied to each of the plurality of blocks or the largest flow rate of fluid discharged from each of the plurality of blocks may be less than 4 times the smallest flow rate of fluid discharged from each of the plurality of blocks.

FIG. 18(*a*) is a schematic view showing the positions of temperature sensors installed to measure the internal temperature of each of the typical heat exchanger and the heat exchanger according to the present invention, and FIG. 18(*b*) shows graphs depicting the temperature distribution inside the heat exchangers measured by the temperature sensors at the positions shown in FIG. 18(*a*). Specifically, Graph (1) of FIG. 18(*b*) shows the temperature distribution inside the typical heat exchanger, and Graph (2) of FIG. 18(*b*) shows the temperature distribution inside the heat exchanger according to the second embodiment of the present invention.

Referring to FIG. 18(*b*), in the typical heat exchanger, the temperature of the middle diffusion block is much lower than those of the other diffusion blocks and there is thus a great difference between temperatures of the plural diffusion blocks. Specifically, in the typical heat exchanger, a difference between the maximum value and the minimum value of the graph is in the range of about 130° C. to about 140° C.

Conversely, in the heat exchanger according to the second embodiment, there is a relatively small difference in temperature between the plural diffusion blocks. Specifically, in the heat exchanger according to the second embodiment, a difference between the maximum value and the minimum value of the graph is in the range of about 40° C. to about 50° C., which is much lower than that in the typical heat exchanger.

According to the present invention, when BOG is used as a refrigerant of a heat exchanger and the heat exchanger includes plural diffusion blocks, the refrigerant can be relatively evenly distributed to the diffusion blocks; a difference in temperature between the diffusion blocks can be reduced to increase heat exchange efficiency; and stable reliquefaction performance can be secured regardless of the amount of reliquefaction target BOG.

Each of the perforated panels may be formed of SUS to shrink when BOG at ultra-low temperature, i.e., a refrigerant, contacts the perforated panel and to return to an original shape after the refrigerant leaves the perforated panel. The thin perforated panel has much lower heat capacity than the heat exchanger. If the perforated panel is welded to the heat exchanger, the perforated panel is likely to break since the heat exchanger having higher heat capacity shrinks less when contacting the BOG and the perforated panel having lower heat capacity shrinks more when contacting the BOG.

Thus, it is required that the perforated panel be coupled to the heat exchanger in such a way that thermal expansion and contraction of the perforated panel can be relieved. Now, methods for coupling the perforated panel according to fourth and fifth embodiments of the present invention will be described, which can relieve thermal expansion and contraction of the perforated panel.

FIG. 19 is a schematic view of a portion of a heat exchanger according to a third embodiment of the present invention, and FIG. 20 is an enlarged view of portion A of FIG. 19.

Like the heat exchanger according to the first embodiment, a heat exchanger according to this embodiment further includes at least one of the first perforated panel 210 disposed between the hot fluid inlet header 120 and the core 190, the second perforated panel 220 disposed between the hot fluid outlet header 130 and the core 190, the third perforated panel 230 disposed between the cold fluid inlet header 160 and the core 190, and the fourth perforated panel 240 disposed between the cold fluid outlet header 170 and the core 190, in addition to the components of the typical PCHE shown FIG. 9.

Referring to FIGS. 19 and 20, the fourth perforated panel 240 is mounted on the cold fluid outlet header 170 by being fitted between two support members 420 separated a predetermined distance from each other and welded (see 410 of FIG. 20) to the cold fluid outlet header 170, rather than being welded directly to the cold fluid outlet header 170.

Since the fourth perforated panel 24 is fitted between the two support members 420 not to be securely fixed to the cold fluid outlet header, the fourth perforated plate is prevented from being bent or broken despite suffering from shrinkage due to contact with BOG at ultra-low temperature and a joint between the fourth perforated plate and the cold fluid outlet header can also be prevented from being broken.

Preferably, the support members 420 are as small as possible to the extent that the support members can accommodate shrinkage of the fourth perforated panel 240, and a distance between the support members 420 is as short as possible to the extent that the fourth perforated panel 240 is slightly movable when suffering from shrinkage.

Similarly to the fourth perforated plate 240, the first perforated panel 210 is fitted between two support members separated a predetermined distance from each other and welded to the hot fluid inlet header 120, the second perforated panel 220 is fitted between two support members separated a predetermined distance from each other and welded to the hot fluid outlet header 130, and the third perforated panel 230 is fitted between two support members separated a predetermined distance from each other and welded to the cold fluid inlet header 160.

FIG. 21 is a schematic view of a portion of a heat exchanger according to a fourth embodiment of the present invention and FIG. 22 is an enlarged view of portion B of FIG. 21.

Like the heat exchanger according to the first embodiment, a heat exchanger according to this embodiment further includes at least one of the first perforated panel 210 disposed between the hot fluid inlet header 120 and the core 190, the second perforated panel 220 disposed between the hot fluid outlet header 130 and the core 190, the third perforated panel 230 disposed between the cold fluid inlet header 160 and the core 190, and the fourth perforated panel 240 disposed between the cold fluid outlet header 170 and the core 190, in addition to the components of the typical PCHE shown FIG. 9.

Referring to FIGS. 21 and 22, as in the third embodiment, the fourth perforated panel 240 according to this embodiment is not welded directly to the cold fluid outlet header 170 despite being mounted on the cold fluid outlet header 170.

The fourth perforated panel 240 according to this embodiment extends parallel to the core 190 at both ends thereof and is stepped away from the core 190. In addition, the fourth perforated panel 240 according to this embodiment is fitted between a single support member 420 and the core 190, rather than being fitted between the two support members 410 as in the third embodiment.

In other words, the single support member 420 is welded to the cold fluid outlet header 170 to be separated a predetermined distance from the core 190 such that both ends of the fourth perforated panel 240 extending parallel to the core 190 are fitted between the support member 420 and the core 190 and the fourth perforated panel 240 is stepped away from the core 190 at a portion thereof inside each of the ends fitted between the support member 420 and the core 190.

Since the fourth perforated panel 24 according to this embodiment is fitted between the support member 420 and the core 190 not to be securely fixed to the cold fluid outlet header 170, the fourth perforated plate is prevented from being bent or broken despite suffering from shrinkage due to contact with BOG at ultra-low temperature, and a joint between the fourth perforated plate and the cold fluid outlet header can also be prevented from breaking.

Preferably, the support member 420 is as small as possible to the extent that the support member can accommodate shrinkage of the fourth perforated panel 240, and a distance between the support member 420 and the core 190 is as short as possible to the extent that the fourth perforated panel 240 is slightly movable when suffering from shrinkage. In addition, preferably, both ends of the fourth perforated panel 240 extending parallel to the core are as short as possible to the extent that the fourth perforated panel can be fitted between the support member 420 and the core 190 and deformation and movement of the fourth perforated panel due to shrinkage is allowable.

Like the fourth perforated panel 240, each of the first to third perforated panels 210, 220, 230 extends parallel to the core 190 at both ends thereof and is stepped away from the core 190. Specifically, the first perforated panel 210 is fitted at both ends thereof between a support member welded to the hot fluid inlet header 120 and the core 190, the second perforated panel 220 is fitted at both ends thereof between a support member welded to the hot fluid outlet header 130 and the core 190, and the third perforated panel 230 is fitted at both ends thereof between a support member welded to the cold fluid inlet header 160 and the core 190.

FIG. 23(*a*) is a schematic view of the entirety of a heat exchanger, FIG. 23(*b*) is a schematic view of a diffusion block, and FIG. 23(*c*) is a schematic view of a channel plate. The block shown in FIG. 23 (*b*) may be a diffusion block.

Referring to FIG. 23, a core 190 in which heat exchange between a cold fluid and a hot fluid occurs includes plural diffusion blocks 192, and each of the diffusion blocks 192 has a structure in which plural cold fluid channel plates 194 and plural hot fluid channel plates 196 are alternately stacked one above another. Each of the channel plates 194, 196 includes a plurality of fluid channels.

FIG. 24(*a*) is a schematic view of the cold fluid channel plate of FIG. 23(*c*), as viewed in direction "C", FIG. 24(*b*) is a schematic view of a channel of a cold fluid channel plate of a typical heat exchanger, FIG. 24(*c*) is a schematic view of a channel of a cold fluid channel plate of a heat exchanger according to a fifth embodiment of the present invention, and FIG. 24(*d*) is a schematic view of a channel of a cold fluid channel plate of a heat exchanger according to a sixth embodiment of the present invention.

Referring to FIG. 24, although a channel 198 engraved in the channel plate is generally uniform in width and is straight, as shown in FIG. 24(*a*), each of the heat exchangers according to the fifth and sixth embodiments of the present invention includes a channel configured to resist a flow of a fluid.

Referring to FIG. 24(*c*), the heat exchanger according to the fifth embodiment includes a plurality of channels 198 which are narrower at an entrance thereof. In other words, the channel 198 according to this embodiment has a smaller area at the entrance in cross-section, as seen in direction "C" of FIG. 23(*c*).

The channel 198 having a smaller cross-sectional area at the entrance allows a fluid entering the channel to be resisted thereby and flow in a diffused manner, thereby reducing or preventing concentration of supply of the fluid in one of the plural diffusion blocks.

Referring to FIG. 24(*d*), the heat exchanger according to the sixth embodiment includes a plurality of zigzag shaped channels 198. The zigzag shaped channel 198 allows a fluid entering the channel to be resisted thereby and flow in a diffused manner, thereby reducing or preventing concentration of supply of the fluid in one of the plural diffusion blocks.

As described above, each of the heat exchangers according to the fifth and sixth embodiments of the present invention includes a channel configured to resist a flow of a fluid and thus can reduce or prevent concentration of supply of the refrigerant in one of plural diffusion blocks without a separate member for fluid diffusion.

It should be understood that various modifications, changes, alterations, and equivalent embodiments can be made by those skilled in the art without departing from the spirit and scope of the invention.

<List of reference numerals>

| | |
|---|---|
| 10: compressor | 20: heat exchanger |
| 30: pressure reducer | 40: gas/liquid separator |
| 110: hot fluid inlet pipe | 120: hot fluid inlet header |
| 130: hot fluid outlet header | 140: hot fluid outlet pipe |
| 150: cold fluid inlet pipe | 160: cold fluid inlet header |
| 170: cold fluid outlet header | 180: cold fluid outlet pipe |
| 190: core | 192: diffusion block |
| 194: cold fluid channel plate | 196: hot fluid channel plate |
| 198: channel | 210, 220, 230, 240: perforated panel |
| 310, 320, 330, 340: partition | 420: support member |

What is claimed is:

1. A boil-off gas (BOG) reliquefaction system for use in a ship having a tank containing liquefied gas cargo, the system comprising:

a compressor configured to receive and compress BOG from the tank to provide a flow of compressed BOG (CBOG);

a heat exchanger configured to heat exchange the flow of CBOG with a flow of BOG from the tank for cooling the flow of the CBOG such that the heat exchanger provides a flow of cooled CBOG and a flow of heated BOG; and an pressure reducer configured to liquefy at least part of the flow of cooled CBOG for returning to the tank, wherein the heat exchanger comprises:

a CBOG inlet header comprising a CBOG inlet pipe for receiving the flow of CBOG from the compressor, a BOG inlet header comprising a BOG inlet pipe for receiving the flow of BOG from the tank, a CBOG outlet header comprising a CBOG outlet pipe for discharging the flow of cooled CBOG, a BOG outlet header comprising a BOG outlet pipe for discharging the flow of heated BOG, and a heat exchanger core configured to heat exchange the flow of CBOG from the CBOG inlet header with the flow of BOG from the BOG inlet header, wherein the heat exchanger further comprises a perforated panel installed inside the BOG outlet header and interposed between the heat exchanger core and the BOG outlet pipe such that the flow of heated BOG from the heat exchanger core travels through the perforated panel to the BOG outlet pipe, wherein the BOG outlet header comprises a support member fixed to an inner surface thereof, wherein a rim of the perforated panel is fitted to inside the BOG outlet header via the support member rather than welding to the BOG outlet header, wherein the perforated panel is made of an SUS material such that the perforated panel is to thermally shrink when the flow of the heated BOG contacts the perforated panel and further such that the perforated panel is to return to an original shape thereof after the flow of the heated BOG leaves the perforated panel, wherein the perforated panel comprises a first end portion, a second end portion, and a middle portion disposed between the first end portion and the second end portion, wherein the first end portion and the second end portion extend parallel to the heat exchanger core and the middle portion is stepped away from the heat exchanger core, wherein the first and second end portions of the perforated panel are disposed between the support member and the heat exchanger core, whereby the perforated panel is not completely fixed to the BOG outlet header and is to thermally shrink and move while being supported by the support member when the perforated panel contacts the flow of heated BOG.

* * * * *